United States Patent [19]

Matsui et al.

[11] 3,991,894

[45] Nov. 16, 1976

[54] APPARATUS FOR AUTOMATIC COP FEEDING

[75] Inventors: Isamu Matsui; Shoji Sakai; Susumu Tsukada; Susumu Kawarabayashi, all of Kyoto, Japan

[73] Assignee: Murata Kikai Kabushiki Kaisha, Japan

[22] Filed: Apr. 2, 1975

[21] Appl. No.: 564,297

Related U.S. Application Data

[62] Division of Ser. No. 278,466, Aug. 7, 1972, Pat. No. 3,945,488.

[30] Foreign Application Priority Data

Feb. 29, 1972 Japan ..... 47-20733
Feb. 29, 1972 Japan ..... 47-20736

[52] U.S. Cl. ..... 214/302; 242/35.5 R
[51] Int. Cl.[2] ..... B65G 65/04
[58] Field of Search ..... 214/301, 6 BA, 314, 214/302, 16.4 C, 16 B; 242/35.5 R, 35.5 A; 198/279

[56] References Cited

UNITED STATES PATENTS 3,295,775 1/1967 Raasch et al. ..... 242/35.5 R
3,480,128 11/1969 Brouwer et al. ..... 242/35.5 R
3,563,479 2/1971 Brouwer et al. ..... 242/35.5 R

FOREIGN PATENTS OR APPLICATIONS 361,748 6/1962 Switzerland ..... 242/35.5 A

*Primary Examiner*—Robert J. Spar
*Assistant Examiner*—Lawrence J. Oresky
*Attorney, Agent, or Firm*—Robert E. Burns; Emmanuel J. Lobato; Bruce L. Adams

[57] ABSTRACT

An apparatus for automatically feeding yarn cops to a cop supply device providing yarn cops to an automatic winder in sequence with the heads and tails of the individual cops properly positioned. The cop supply device has a cop sequencing device receiving cops thereon randomly and discharging them one-by-one in sequence. The cops are conveyed from the cop sequencing device and may be sorted and stored automatically in groups according to characteristics of yarn thereon. The automatic winder controls the cop sequencing device output depending upon its own demands and the cops are transported by means controlled by the winder for routing to the winder and are arranged by means automatically as to the relative positions of the heads and tails thereof in a desired relative position.

10 Claims, 53 Drawing Figures

APPARATUS FOR AUTOMATIC COP FEEDING

This is a divisional, of application Ser. No. 278,466, filed Aug. 7, 1972 now U.S. Pat. No. 3,945,488 issued 3/23/76.

BACKGROUND OF THE INVENTION

The present invention relates to apparatus for automatic cop feeding, more particularly relates to apparatus for transferring cops doffed from spinning machines to supply stations of automatic winders.

Conventionally, there have been generally used automatic cop feeding apparatus whereon yarn ends delivered from cops are pieced with yarn ends from corresponding packages under winding so as to feed cops to automatic winders. In case of the feeding apparatus of this type, however, it is indispensable to feed the individual cops to this apparatus after the head and tail direction of the cops should be preliminarily adjusted. In other words, a great deal of manual labour is needed in order to adjust the head and tail direction of the cops on their course from the spinning machine from which they were doffed to the feeding apparatus.

SUMMARY OF THE INVENTION

In view of this point, in the system of the present invention, cops fed at random are issued separately in sequenced order by processing them through a cop sequencing device of the high frequency vibration type, the head and tail direction of the cops is automatically adjusted by a cop direction controller and the two elements are connected to the automatic winder by a cop conveyer or conveyers. Through employment of this invention, cops doffed at random from the spinning machines can be automatically fed to the automatic winder or winders in prescribedly sequenced order and in the controlled head and tail direction, thereby implying the possibility of a perfectly automatic connection of the spinning machine(s) with automatic winder(s).

BRIEF DESCRIPTION OF THE DRAWINGS

Further features and advantages of the present invention will be made clearer from the following description, reference being made to the accompanying drawings, in which.

DESCRIPTION OF THE PREFERRED EMBODIMENTS

ONE TO ONE WINDER TYPE ARRANGEMENT

Figure 1:
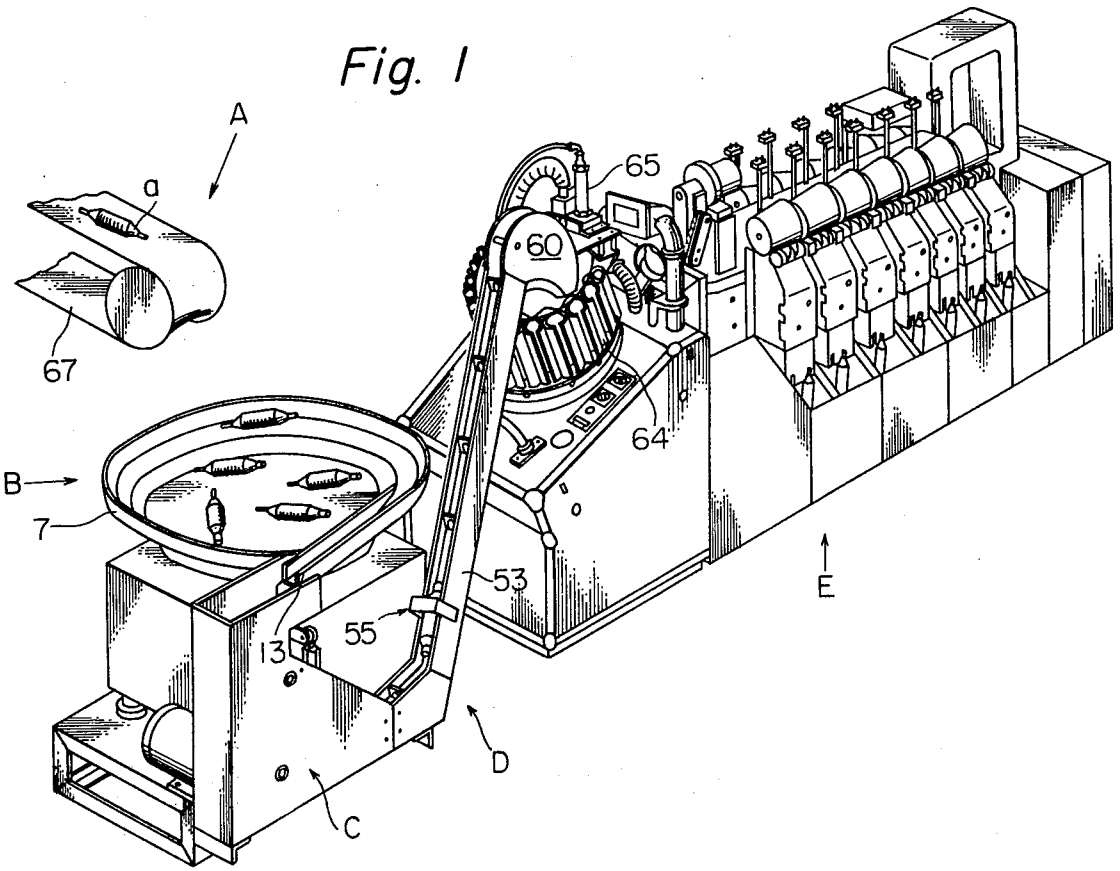
FIGS. 1 and 2 represent the entire structure of the first embodiment of the apparatus of the present invention.
Figure 2:
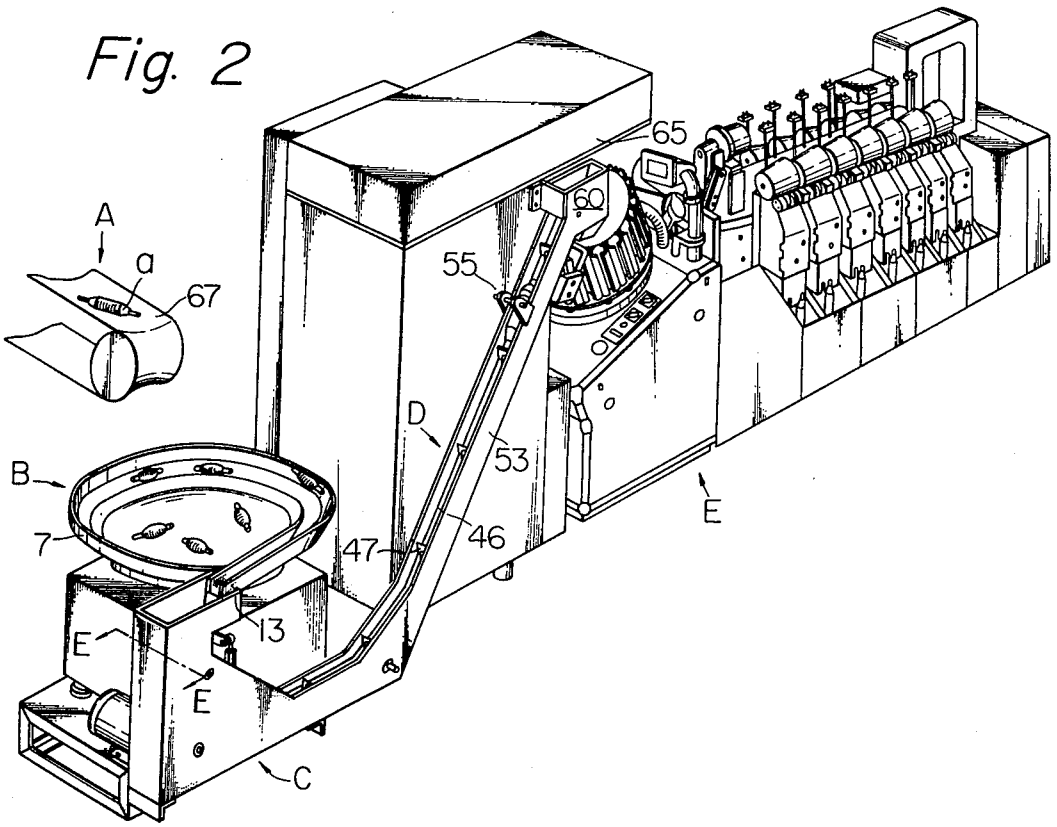
Figure 3:
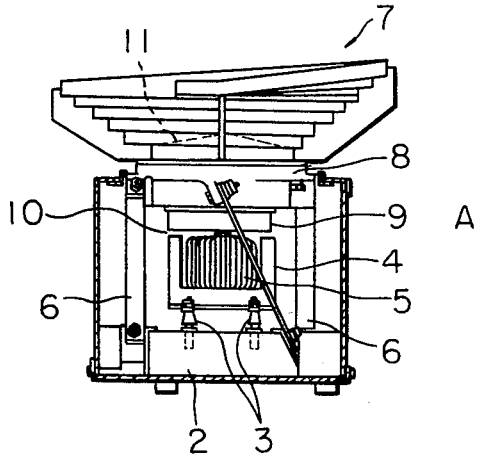
FIG. 3 is a top plane view of the feeder part of the cop sequencing device.
Figure 4:
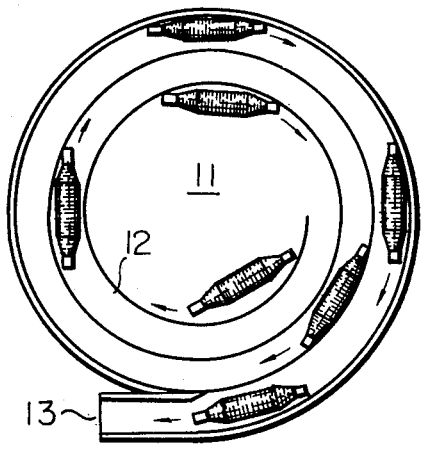
FIG. 4 is a vertical sectional plane view of the cop sequencing device.

The entire structure of the main part of the first embodiment of the apparatus of the present invention is illustrated in FIGS. 1 and 2, wherein cops doffed from the spinning machine are thrown at random into a cop sequencing device B by a conveyer device A and the outlet end of the cop sequencing device B is connected to a cop direction controller C which is connected to a cop conveyer D for conveying the cops in a controlled order towards the automatic winder E.

THE COP CONVEYER DEVICE A

Cops doffed from the spinning machine are conveyed, in a random disposition, toward the cop sequencing device C and are thrown into a feeder of the sequencing device C. This conveyer device A can be given a form of a conveyer assembly holding a number of hanging buckets or a number of boxes which are overturnable over the feeder 7 of the sequencing device C. Various modifications of the conveyer device A are employable. In the case of the present embodiment, cops are simply placed on a circulating conveyer belt 67. Further, they may be manually thrown into the feeder 7 of the sequencing device C.

THE COP SEQUENCING DEVICE B

As shown in FIGS. 1 to 4, a fixed core 4 and an energizing coil 5 for the fixed core are fixed to a framework 2 by set bolts 3. Four sets of leaf springs 6 are obliquely and fixedly mounted on the framework 2 in order to hold a supporter 8 on which the feeder 7 is fixed. The supporter 8 is accompanied by a movable core 9 fixed to the bottom face thereof, and the movable core 9 is so positioned as to leave a gap 10 between the two cores 4 and 9.

The feeder 7 is provided with a convex center rise 11 encircled by a peripheral slope 12 rising outwards. The peripheral slope 12 is provided with a helical path which runs in succession from the center rise 11 towards the fringe of the feeder 7. Two or more helical paths may be formed together on the slope 12 in an arrangement substantially the same as the above-described embodiment. As seen in the drawings the path is properly stepped from one turn to the next turn in the helix.

When pulsating current flows in coil 5, fixed core 4 is repeatedly excited and de-excited at such a high frequency as amounting to several thousands times per minute. By this exciting of fixed core 4, movable core 9 is attracted by fixed core 4 at high frequency, leaf springs 6 holding supporter 8 are repeatedly stressed and this causes three dimensional, high frequency, small vibration of feeder 7. Due to this vibration, cops in feeder 7 are tossed and displaced toward the lower skirt of center rise 11 and, thereafter, start to climb slope 12 along helical path while being tossed restlessly. In this case, the cops are advanced along the path one by one in sequenced order, issued from an issuing terminal 13 into a chute 40 and transferred onto the cop direction controller C.

Figure 10:
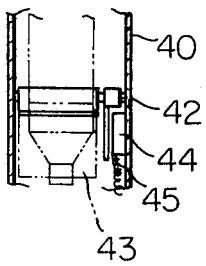
FIG. 10 represents construction of the vibration interceptor.

The chute 40 is provided, at its upper end, with a vibration interceptor 41. As is shown in FIG. 10, the vibration intercepter 41 consists of a shaft 42 turnably disposed to the chute 40, a cover plate 43 fixed, to the chute 40, a contact switch 44 fixed to the chute 40 and an operator plate 45 fixedly mounted onto the shaft 42 in an arrangement operable on the contact switch 44. The contact switch 44 is electrically connected to the vibration actuating source of the feeder 7. At every passage of the individual cops through the chute 40, the vibration of the feeder 7 is temporarily stopped due to the provision of the vibration interceptor 41.

THE COP DIRECTION CONTROLLER C

The cop direction controller C is illustrated in FIGS. 5 to 9, wherein a pair of side walls 15 and 16 are mounted on a base 14 being parallelly spaced from each other leaving a gap sufficient for allowing free passage of the cops.

A swingable lever 18 is pivoted to a pin 17 on the side wall 15 with the other end of it being connected to a crank disc 19 via a connecting rod 20. The crank disc 19 is connected to a drive motor (not shown) via a suitable clutch mechanism.

A swingable pusher rod 22 of L-shaped structure is pivoted to a pin 21 on the side wall also and the bent end 23 thereof extends into the path of the cops through an arched slot 24 formed through the side wall 15. In the stand-by disposition shown in FIG. 5, the bent end 23 rests in a groove 26 of a bottom plate 25 so that it does not hinder the passage of the cops.

An arm 27 is pivoted, at its one end, to the pin 21 forming one body with the pusher rod 22 and a hook lever 28 is turnably linked to the other end of the arm 27. The hook lever 28 has a hook 29 formed on its free end, which is engageable with a projection 30 fixed on the stem of the swingable lever 18.

At the lower ends of the side walls 15 and 16, a sensory plate 31 is turnably mounted to a pin 32 in one body with a supporter lever 33 which is accompanied with a spring 34. By this spring force, the sensory plate 31 is resiliently urged clockwisely for contact with selector plates 36 and 37. The supporter lever 33 is provided with a lateral pin 35 fixed to the free end thereof and the hook lever 28 rests upon this lateral pin 35 in order to restrain the counter-clockwise turning of the elements 31 and 33.

Both selector plates 36 and 37 are fixed to the side walls 15 and 16, respectively, and the narrowest spacing ($l$) between the two is so selected that it permit a smooth passage of the cop head but not of the cop bottom. In the drawing, the arm 27 is accompanied by a spring 38 for assisting the return movement of the pusher rod 22 and the side walls 15 and 16 are provided with a reinforcing rib 39 positioned between the two.

THE COP CONVEYER D

Figure 5:
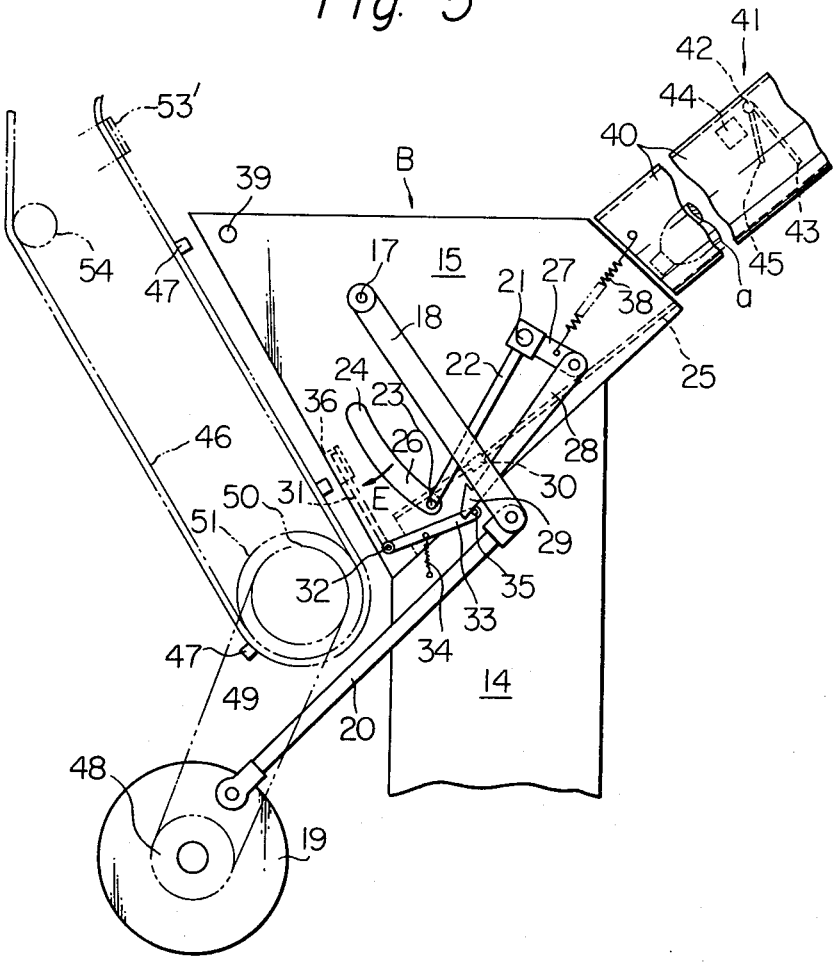
FIG. 5 represents structure of lower part of the cop direction controller and the cop conveyer.
Figure 6:
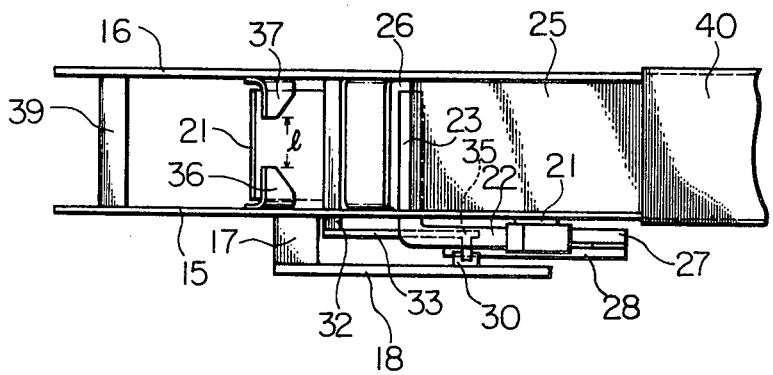
FIG. 6 is a top plane view of the cop direction controller and the cop conveyer.

Referring to FIG. 5, a belt conveyer 46 is provided with multiple outer surface projections 47 and runs almost in parallel and facing close to the above-described sensory plate 31. The run of this belt conveyer 46 is guided by a driver wheel 51 positioned on the lower part of the assembly D and a driver wheel 52 positioned on the upper part of the assembly D. The lower driver wheel 51 is accompanied by a pulley 50 which is connected to a pulley 48 of the crank disc 19 for rotation via a belt 49. For a smooth run of the belt conveyer 46, guide plates 53 and 53' and guide rolls 54 are attached to suitable parts of this belt conveyer mechanism.

Figure 11:
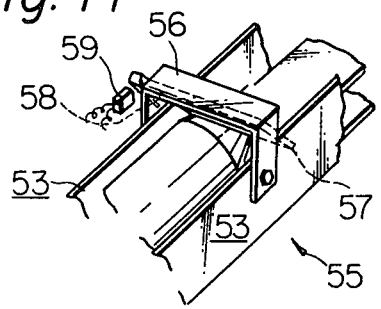
FIG. 11 is a perspective plane view of the arrangement for confirming the passage of the cops.

A sensory device 55 of the cops passage is attached to a suitable portion of the guide plate 53. In the arrangement shown in FIG. 1, the device 55 is located near the lower end of the cop conveyer D while, in the arrangement shown in FIG. 2, the same is located near the upper end of the cop conveyer D. The detail structure of this sensory device 55 is illustrated in FIG. 11, in which the device 55 includes a horizontal gate 56 bridging the guide plates 53 across the path of the cops. The gate 56 is provided with a contact plate 57 turnably disposed to the inside face of the gate 56, and an operator plate 58 is disposed in one body to the outer extension of the contact plate 57. The purpose of this operator plate 58 is to act on a switch 59 located sideways of the guide plate 53. This switch 59 is electrically connected to the crank disc 19.

Figure 12:
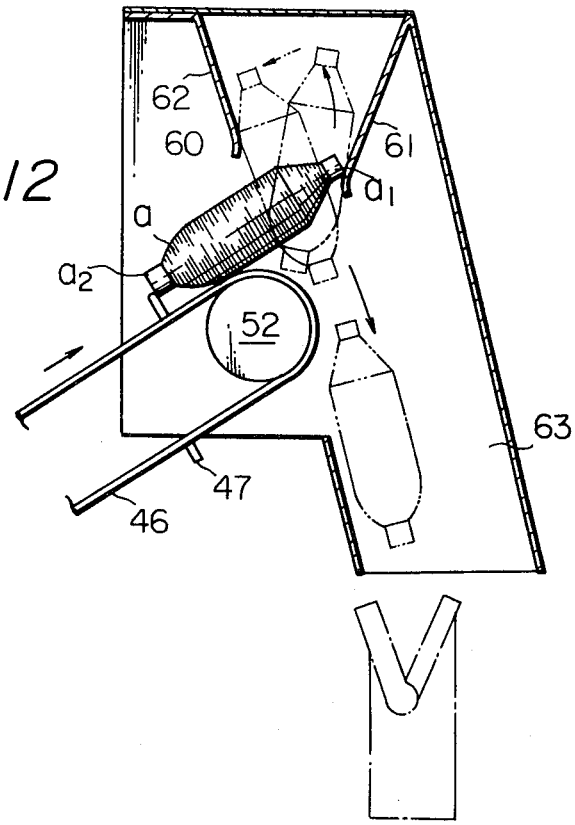
FIG. 12 represents the operational condition of the arrangement for converting the cop direction.

The structure of the upper end of the cop conveyer D is illustrated in detail in FIG. 12. As is clear from the illustration, the upper drive wheel 52 of the belt conveyer 46 forms a part of a cop direction converter part 60 in combination with a pair of members 61 and 62 located above the wheel 52. A guide chute 63 is formed downwardly integral of the direction converter part 60.

THE AUTOMATIC WINDER E

On the automatic winder E, yarn ends are delivered from cops thrown into a magazine of known structure and yarn ends so delivered are tied with yarn ends of the pirns on the corresponding winding units. The winder includes a mechanism for automatically feeding cops thereto. Electric connection between the automatic winder E and the crank disc 19 via the feeder 7 will be explained later in more detail.

SEQUENTIAL OPERATION OF THE APPARATUS

The sequential operation of the apparatus of the present invention having the above-explained structure is as follows.

The full cops doffed on the spinning machine are brought in succession into the feeder 7 automatically by the conveyer belt 67 or manually by the hand work of the operator or operators.

At the stage when the supply of the new cops is not required by the atuomatic winder E and the sensory device 55 of the cop conveyer D senses the presence of the cop, both the conveyer device A and the cop sequencing device B stand still. Both the vibration of the feeder 7 and the travel of the belt conveyer 46 are not yet started. Meanwhile, only the automatic winder E carries on its winding operation.

When the automatic winder E is placed under a condition to require supply of new full cops, instruction signals are electrically issued by the automatic winder E concurrently to the crank disc 19 and the feeder 7. Then rotation of the drive motor is transmitted to the crank disc 19 via a clutch mechanism attached thereto, so as to cause the travel of the belt conveyer 46. By this travel of the belt conveyer 46, cops standing by on the cop conveyer D are now supplied to the automatic winder E and the cop direction controller C waits for the supply of the cops from the feeder 7.

When the cops are not thrown into the cop direction controller C, the sensory plate 31 is kept in contact with the selector plates 36 and 37 by the spring force of the spring 34, and; the hook 29 of the hook lever 28, which is held by the lateral pin 35 of the supporter lever 33, is maintained outside the moving ambit of the projection 30. Rotation of the crank disc 19 causes only the corresponding swinging of the swingable lever 18.

Simultaneously with the starting of the crank disc rotation, the feeder 7 starts its vibration and the cops, which were already piled up on the center rise 11, are brought, being tossed by the vibration, to the issuing terminal 13 so that they are thrown in order into the chute 40. This falling of the new cop causes a corresponding turning of the cover plate 43, and the operator plate 45 associated therewith depresses the contact switch 44 so as to electrically intercept the vibration of the feeder 7.

Figure 7:
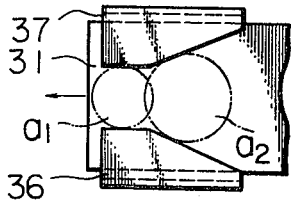
FIG. 7 is a view seen in the direction of an arrow E in FIG. 5, FIGS. 8 and 9 represent operational condition of the cop direction controller.
Figure 8:
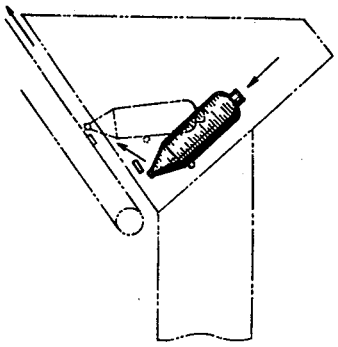
Figure 9:
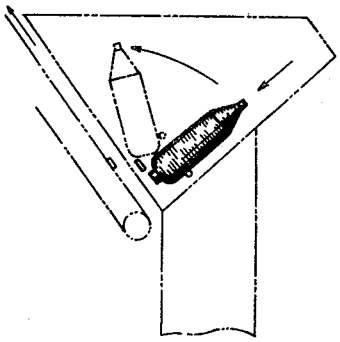

When one cop is thrown into the chute 40 from the feeder 7, it arrives at the position of the sensory plate 31 sliding down along the bottom plate 25 of the chute 40. Through contact with the cop so supplied, the sensory plate 31 turns counter-clockwise about the pin 32 overcoming the spring force by the spring 34, and the lateral pin 35 of the supporter lever 33 turns the hook lever 28 clockwise so as to place the hook 29 within the moving ambit of the projection 30. In this disposition, the projection 30 engages with the hook 29, upon clockwise swinging of the lever 18, and pulls down the hook lever 28 in the same direction so that a clockwise turning of the pusher rod 22 about the pin 21 is caused thereby. By this turning of the pusher rod 22, the lower half of the cop is pushed leftwardly and upwardly in FIG. 5 illustration and the bobbin part of the cop is pushed into the gap between the selector plates 36 and 37. When the cop head $a_1$ is directed downwards as shown in FIG. 7, the cop head $a_1$ passes smoothly through the gap between the plates 36 and 37 and the cop is discharged outside with its head being positioned on the leading side as shown in FIG. 8. On the other hand, when the cop tail $a_2$ is directed downwards as shown in FIG. 7, the cop tail $a_2$ cannot go through the gap between the plates 36 and 37 and the movement thereof is here hindered. However, as the pusher rod 22 presses the cop by its turning, the cop is forced to turn about its tail side end and is discharged outside with its head being positioned on the leading side as shown in FIG. 9. In both cases, the cops are discharged outside with their head being positioned on the leading side. The cops so discharged in order are transported upwards, being picked up by the surface projections 47 of the belt conveyer 46.

When the cop $a$ so transported upwards by the belt conveyer 46 arrives at the position of the sensory device 55, the switch 59 attached thereto is operated via the members 57 and 58. This stops the rotation of the crank disc 19 and the cop $a$ stands by at this position until the automatic winder E becomes ready for receiving new cops. This is just the initial disposition already described and the operation is repeated in the above explained sequence.

Upon issuance of suitable electric signal from the automatic winder E, the cop $c$, which has waited on the belt conveyer 46, is further advanced till the position of the cop direction converter part 60. Then, as shown in FIG. 12, the cop head $a_1$ firstly abuts against a contact member 61 and, as the cop tail $a_2$ is compulsorily pushed up by the surface projection 47 of the belt conveyer, the cop $a$ is put into a vertical standing position. In this vertical standing position, the cop head $a_1$ tilts towards a counter member 62 and, because of the cancellation of the support for the cop tail $a_2$, the cop $a$ falls down into the guide chute 63 with its head $a_1$ being directed upwards. By the falling, the cop $a$ is received in the corresponding magazine 64 of the automatic winder E. When the cop $a$ held in the magazine 64 is brought to the position of a mechanism 65 for unwinding the top bunch, the top bunch is unwound off the cop *a*. (see FIG. 1)

Figure 13:
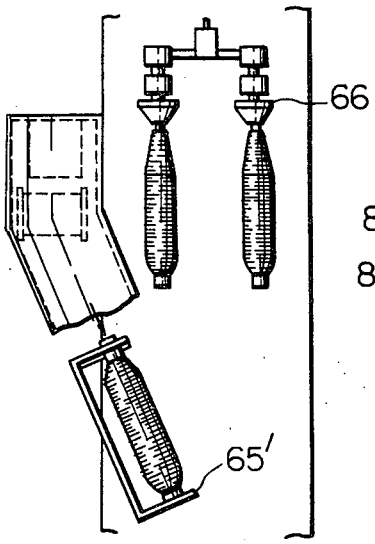
FIG. 13 represents the operational condition of the chuck in the cop receiver.

In the case of the arrangement shown in FIG. 2, the cop *a* falling down through the guide chute 63 is once received on a cop holder 65', as shown in FIG. 13, and the cops so held are hoisted by chucks 66. After removal of the top bunch in the rewinding mechanism 65, the cops are supplied into the magazines 64 of the automatic winder E.

Referring to FIGS. 14 to 17, a different embodiment of the cop direction controller C is shown. The controller C includes, as major components, an issuing chute 71 of cops from the cop sequencing device B and a cop conveyer belt 72 located below the outlet of the chute 71. The spacing between the outlet of the chute 71 and the upper side run of the belt 72 is somewhat longer than the length of cops. Midway between the members 71 and 72, a shaft 74 is laterally and horizontally disposed to the machine framework and a cop receiver 75 is pivotally mounted on the shaft 74 on the backside thereof. The cop 73 issued from the chute 71 is received on the bottom plate 76 of the receiver 75.

Figure 17:
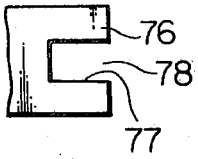

As shown in FIG. 17, the bottom plate 76 is provided with a forwardly opening (78) cut-out 77. The width of the cut-off 77 is equal to or larger than the diameter of the cop head 73A on the one hand, and smaller than the diameter of the cop tail 73B on the other. Further, in front of the vertical part of the cop receiver 75, a receiver plate 79 is located vertically and parallel to the axial direction of the horizontal shaft 74. The location of the plate 79 is so selected that, when the cop 73 on the cop receiver 75 tilts forwardly, the cop tail 73B comes in contact with the plate 79. The plate 79 is provided with a downwardly opening rectangular cut-out 80 whose dimension is the same as that of the cut-out 77 of the bottom plate 76. (see FIG. 16)

The cop receiver 75 is provided, on its rear face, with a weight arm 81 extending rearwardly, and a weight 82 is mounted on the arm 81, the position of which is adjustable. The position of the weight 82 should be so adjusted that the cop receiver 75 can easily be turned clockwisely in FIG. 15 when the cop 73 falls on it. Further, a stopper 83 is provided so as to keep the cop receiver 75 in the right position after the cop 73 is unloaded therefrom.

Figure 14:
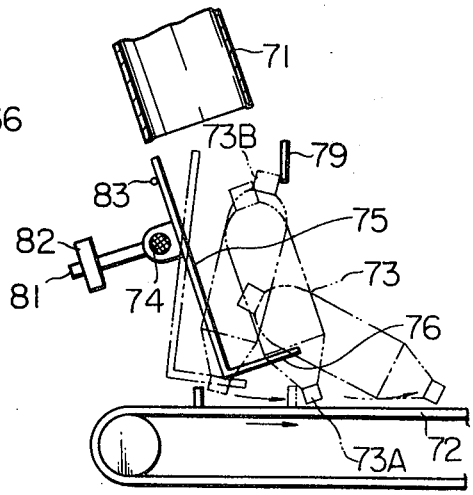
FIGS. 14 to 17 represent the structure and operational condition of a different embodiment of the cop direction controller.

When a cop 73 falls on the cop receiver 75 from the issuing chute 71 with the cop head 73A being directed downwards as shown in FIG. 14, the cop head 73A is received in the cut-out 77 of the bottom plate 76. Concurrently, due to the self-weight of the cop 73, the receiver 75 turns clockwisely in the drawing and the cop tail 73B comes in contact with the receiver plate 79. In this case, tilting of the cop 73 is hindered by the plate 79 because the diameter of the cop tail 73B is larger than the width of the cut-out 80 of the plate 79. Due to this hinderance by the plate 79, the cop head 73A escapes out of the cut-out 77 on the bottom plate 76 onto the upper run surface of the conveyer belt 72. The cop 73 is brought away by the running conveyer belt 72 with the cop head 73A being located on the leading side.

Figure 15:
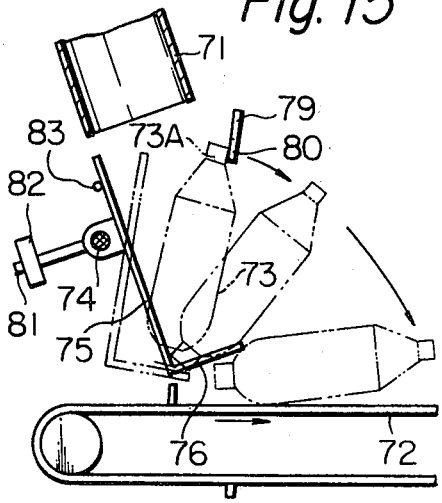
Figure 16:
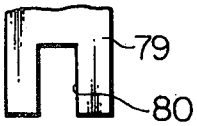

On the other hand, when a cop 73 falls on the cop receiver 75 from the issuing chute 71 with the cop head 73A being directed upwards as shown in FIG. 15, the cop tail 73B cannot be received in the cut-out 77 of the bottom plate 76 because the diameter of the former is larger than the width of the latter. Concurrently, due to the self-weight of the cop 73, the receiver 75 turns clockwisely in the drawing and the cop head 73A tilts towards the receiver plate 79. Because the width of the cut-out 80 of the plate 79 is not smaller than the diameter of the cop head 73A, the cop head 73A goes through the cut-out 80 of the plate 79 and the cop 73 finally rests on the upper run surface of the conveyer belt 72. By circulation of the belt 72, the cop 73 is brought away with the cop head 73A being located on the leading side.

This modified embodiment is advanced from the already-described basic embodiment of the cop direction controller C by its simplicity in the construction. That is, the sensory plate 31 used in the foregoing embodiment can be omitted in this embodiment.

Owing to the already-described construction of the apparatus of the present invention, the cops are transported till the issuing terminal 13 of the feeder 7 while being tossed finely at high frequency. Such transportation mechanism assures quick sequencing of a great number of cops fed at random into the feeder 7 with minimized formation of fluffs on the cop surfaces.

Further, thanks to the equipment of the vibration interceptor 41, under the issuing terminal 13 of the vibrating feeder 7, the cops can be supplied in correct order to the automatic winder without any risk of wedge building by the cops or disturbance of the direction of cops during processing. Therefore, a remarkable enhancement of the process efficiency can be attained by employment of the apparatus of the present invention.

ONE TO MULTI WINDERS TYPE ARRANGEMENT

In the arrangement of the foregoing embodiments, a set of cop sequencing device B is always accompanied with a set of automatic winder E. However, when the processing rate of the cop sequencing device B is by far greater than that of the atuomatic winder E, it is impossible to make the cop sequencing device B work at its utmost operational efficiency. Further, even when any one of the elements A to D accidentally gets out of order, there is no time available for repairing the element or elements in the wrong condition.

It is from this point of view, that the following embodiment, of the apparatus of the present invention, should be appreciated.

In the case of this embodiment, one set of cop sequencing device B is accompanied by multiple sets of automatic winders E, and the feeder 7 of the cop sequencing device B is provided with two or more sets of helical paths for the cops. By employment of such modified arrangement it is possible to provisionally storage cops at the time of machine malfunctions. It is further possible, through employment of such modified arrangement, to provisionally store the cops in separate groups according to their differences in yarn count, yarn type and so on. In the case of this embodiment, however, the cop direction controller C is located at a position downstream of the cop conveyer D in order to obviate the possible poor operation thereof. The arrangement of this embodiment firstly includes a conveyer device A which is made up of a cop container aligning mechanism 100 and a container overturning mechanism 200. A plurality of cop containers, in which cops doffed from the spinning machine are deposited in random disposition, stand by on the cop container aligning mechanism 100. The container overturning mechanism 200 overturns the cop containers in order to dishcarge the cops from them into the feeder 7 of the cop sequencing device B. When necessary, the aligning mechanism 100 feeds a cop container in a bucket of the overturning mechanism 200. And, after the overturning, the cop container is turned onto the aligning mechanism 100 from the overturning mechanism 200. The cop sequencing device B is here given in the form of an assembly 300 having a feeder which is provided with three sets of helical paths for guidance of the cops fed from the cop container. The feeder is accompanied by a conveyor assembly 400 in order to transfer the cops while retaining their horizontal disposition to a cop boxing assembly 500 containers the cop conveyor D. Circulation of the cop container on the cop boxing assembly 500 is controlled by a cop boxing station 600. Whereas circulation of the cop containers on the side of the automatic winder E is controlled by a supply station 700. A traverser assembly 800 is located between the two stations 600 and 700 in order to carry out the transfer of the cop containers between the stations 600 and 700. Cops issued from the cop sequencing device B are once boxed in the top containers and the cop containers so filled with cops are provisionally placed on the cop boxing station 600. Once the supply of the full cops is required on any of the automatic winders E, the traverse assembly 800 carries the containers to the supply station 700 of that automatic winder E. By installing separate cop boxing stations 600 according to the difference in the yarn type, distribution of cop containers to proper automatic winders E can be centrally controlled. The cop direction controller C of this embodiment includes an assembly 900 disposed to the cop transporting part 700d of the supply station 700.

THE CONVEYOR DEVICE A

Figure 18:
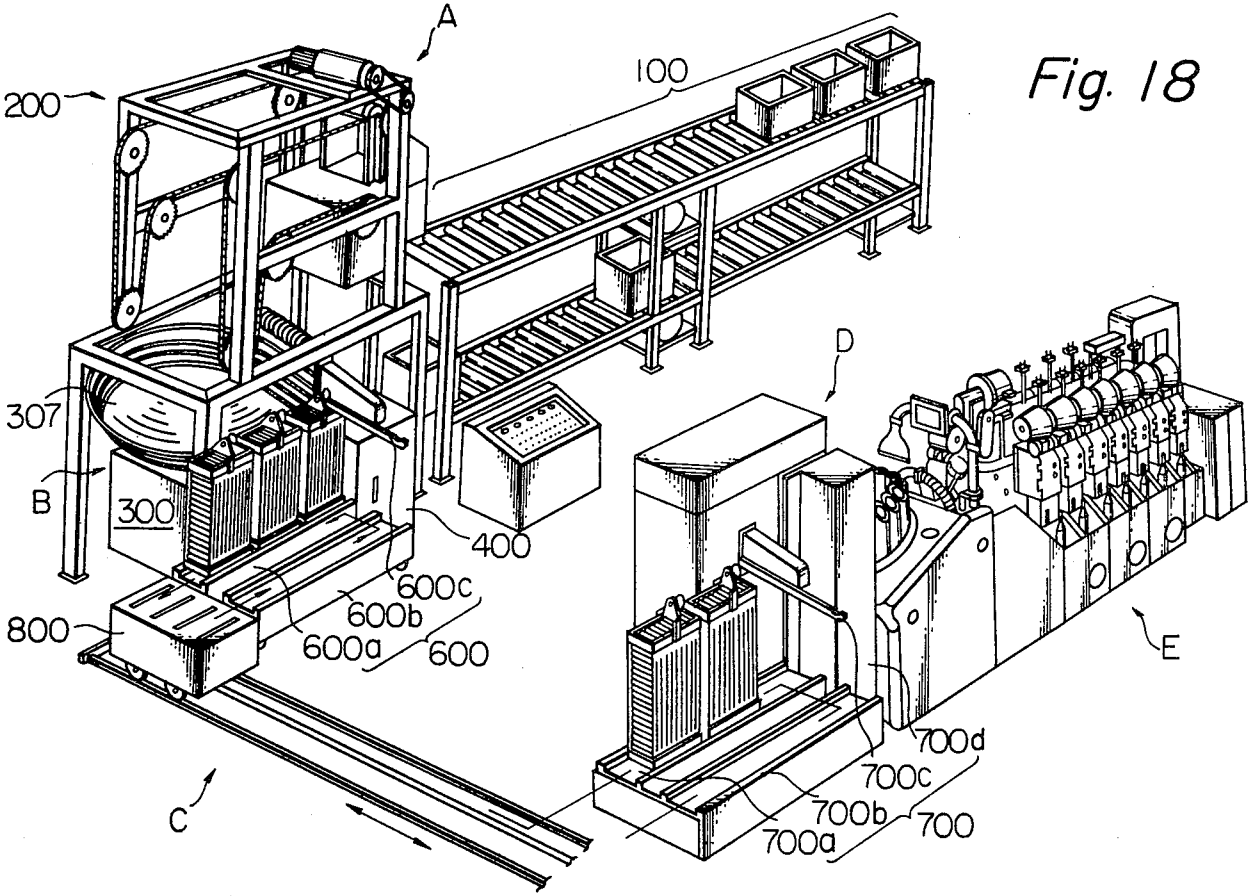
FIG. 18 is a perspective plane view of the second embodiment of the apparatus of the present invention.

As shown in FIGS. 18 to 23, the cop container aligning mechanism 100 is provided with roller conveyers 102, 102′, 103 and 103′ supported by machine frameworks 101. In FIG. 18, the roller conveyers 102 and 102′ are inclined downwardly towards the container overturning mechanism 200, whereas the roller conveyers 103 and 103′ are also inclined but rising towards the container overturning mechanism 200. In parallel to the roller conveyers, guide rails 104 and 105 are also disposed.

In between the two roller conveyers 102 and 102′, a cop container pusher assembly 106 is movably arranged in parallel to the conveyers. The pusher assembly includes a pair of side-by-side spaced elongated plates 108, provided with sideway rolls 107 and 107′; a pusher rod 109, pivotally mounted between the plates, and; a spring 110, for always urging the pusher rod into a clockwise turning. The pusher assembly 106 is covered by an upper cover 111 having elongated openings 112 and 113 on both ends thereof. The pusher assembly 106 is further provided with a chain 115 disposed to a lower projection 116 and driven by a motor 114, by which the assembly 106 can be moved laterally. Switches 117 and 118 are disposed to the arrangement in order to stop the movement of the pusher assembly 106.

A sector cam 119 is disposed near the switch 118 between the roller conveyers 102 and 102′. The upper end of the cam 119 always extends over the level of the roller conveyer 102. This is due to the arrangement that a lateral pin 120, planted to one side face of the cam 119, engages a slot of a bent lever 122 which is always urged into a clockwise turning, in FIG. 21, by a spring 121.

A drawer assembly 123 for the cop containers is movably disposed in between and parallel to the upper roller conveyers 103 and 103′ of the aligning mechanism 100. The drawer assembly 123 includes a pair of elongated mutually parallel plates, 125 provided with sideway rolls 124 and 124′; a drawer hook 126, located in between the two plates 124, and; a chain 128 disposed to the lower part thereof and driven by a motor 127. The drawer assembly 123 is further accompanied by a pair of switches 129 and 130 for stopping the movement thereof, and a detector switch 131 for sensing the presence of the cop containers. A stopper 132 is disposed along in an arrangement being urged into a clockwise turning by a spring 133. The stopper 132 is accompanied by a stop pin 134. When the cop container arrives at the position of the spring 133, the latter functions to stop the cop container by overcoming the tendency of movement of the container. Whereas, when the container is pushed out by the pusher assembly, the spring 133 is extended and the stopper 132 is turned counterclockwise.

The container overturning mechanism 200 is illustrated in FIGS. 24 to 27, wherein six sets of sprockets 202 to 207 are mounted onto a machine framework 201. An endless chain 208, running in engagement with the six sprockets, is driven by a drive motor 209. A bucket 210 travels along a pair of guide rails 211, being carried by the endless chain 208. The endless chain 208: goes down to the location of the lowest sprocket 203; goes up from there to the location of the sprocket 204 of the intermediate level; moves almost horizontally until the location of the sprocket 205, which is located at the same level of the sprocket 204; goes down again to the location of the sprocket 206, which is somewhat lower than the sprocket 205; again goes up to the location of the highest sprocket 207; runs horizontally to the location of the sprocket 202, and; again goes down towards the lowest sprocket 203. The guide rails 211 are so mounted to the framework 201 that, as the bucket 210 travels from the position of the sprocket 203 to that of the sprocket 206, rolls 212 disposed on both sides of the bucket 210 contact the guide rails and the bucket 210 is overturned at the position of the sprocket 206.

Figure 26:
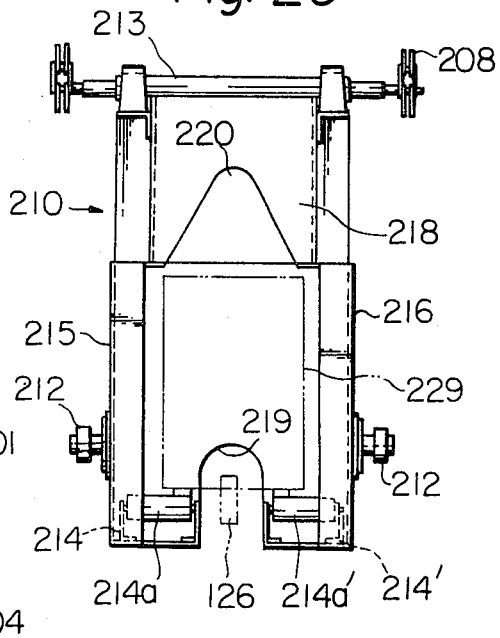
FIG. 26 is a back plane view of a bucket.
Figure 27:
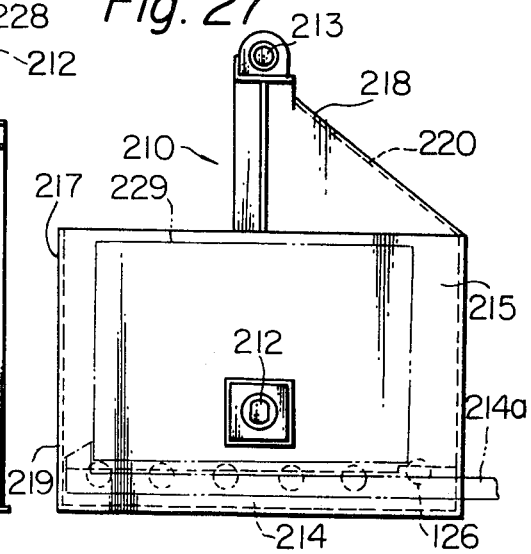
FIG. 27 is a front plane view of the bucket.
Figure 28:
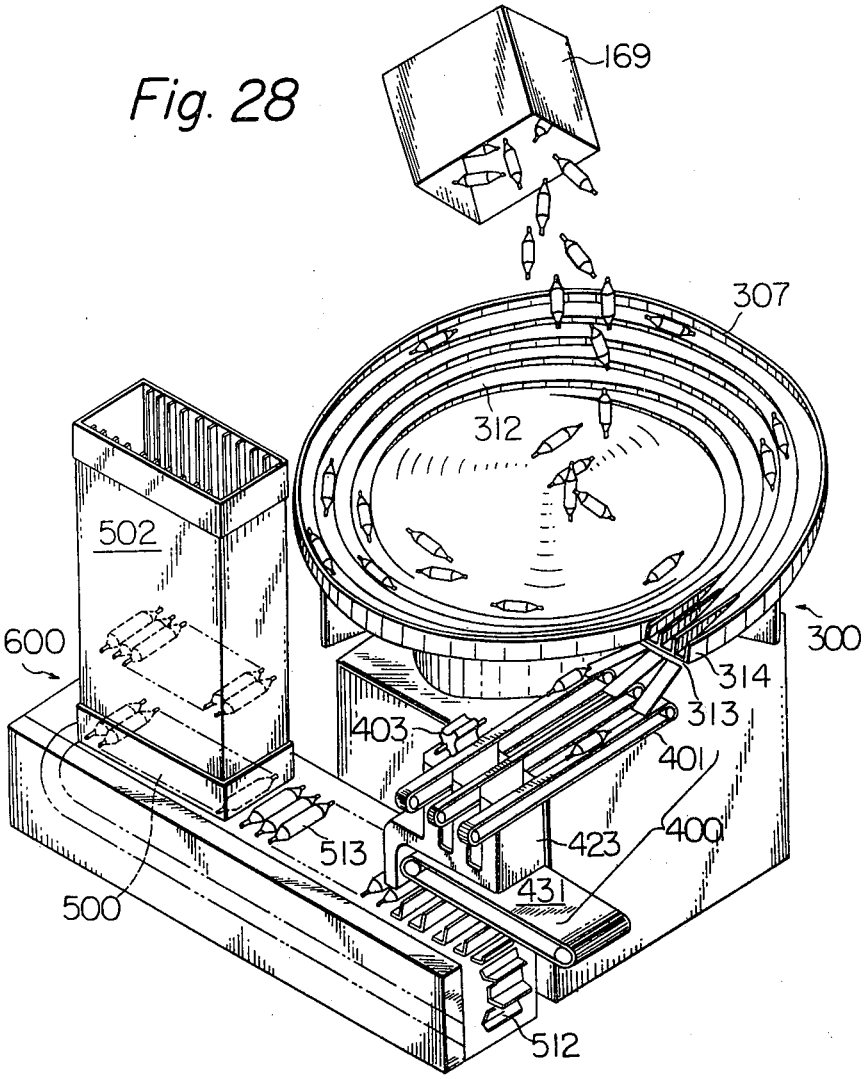
FIG. 28 is a perspective plane view of a cop sequencing device, a conveyer assembly and a cop boxing assembly.

As shown in FIGS. 26 and 27, the bucket 210 is of a box type and is hung from a shaft 213, which is carried at both ends by the endless chain 208. Two alignments of roller conveyers 214 and 214′ are disposed to the bottom side of the bucket 210 in such a manner that only the terminal roller conveyers **214*a* and 214′*a* are located at a somewhat higher level than the remaining roller conveyers. The bucket 210 is covered with coverings on its four sides, i.e. the side faces 215 and 216, the back face 217 and the upper face 218. The covering is provided with cut-outs 219 and 220.**

Figure 24:
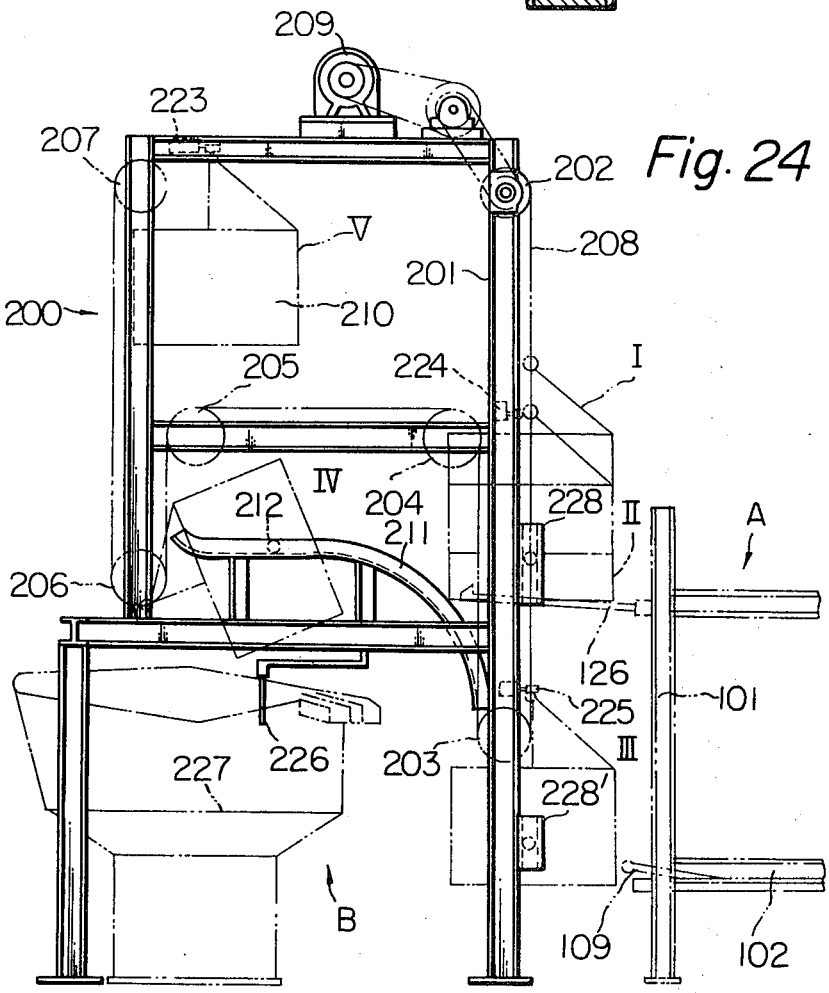
FIG. 24 is a side plane view of the container overturning mechanism.
Figure 25:
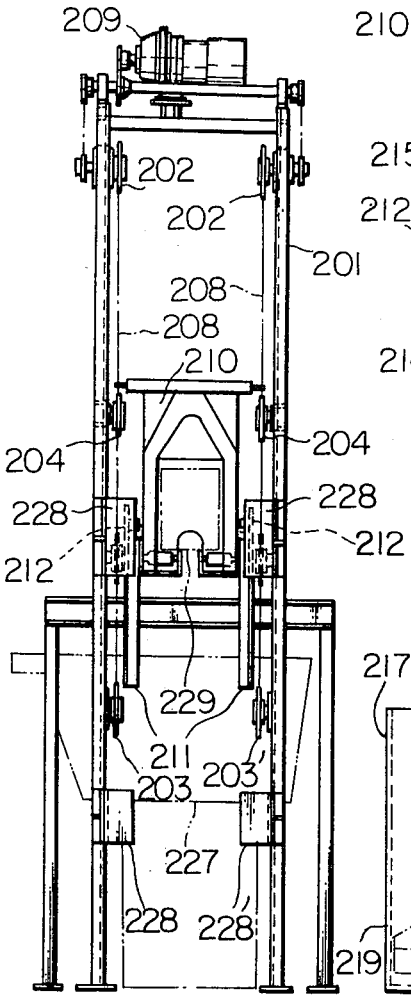
FIG. 25 is a front plane view of the container overturning mechanism.

As shown in FIG. 24, three set of switches 223, 224 and 225 are mounted onto the framework 201. Further, there is provided on the framework 201, a feeler lever 226 for sensing the presence of the cops on the bobbin feeder 307. When the absence of the cops on the feeder is sensed, the drive motor 209 is energized. A ⊐-shaped guide 228 is mounted onto the framework 201 in order to restrain the vibration of the bucket 210, through engagement with the rolls 212, when the bucket 210 comes to the location of the sprocket 203.

THE COP SEQUENCING DEVICE

Figure 29:
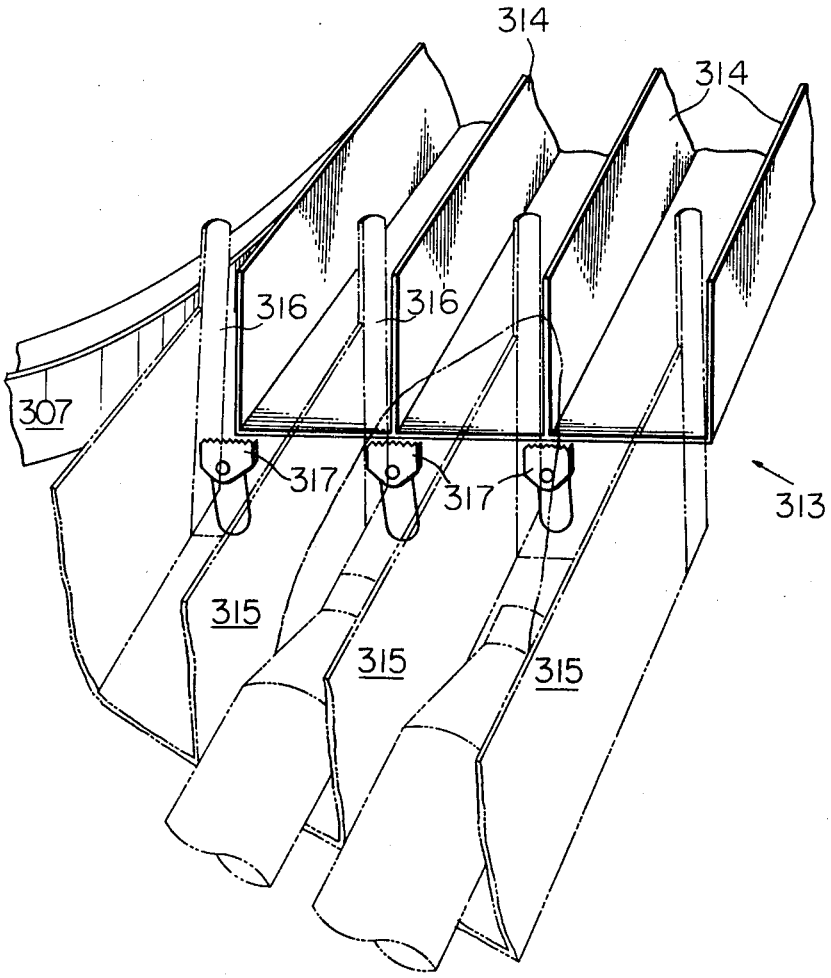
FIG. 29 is a perspective plane view of a cutter part of the cop sequencing device.

The assembly 300 (cop sequencing device) in the present embodiment is substantially the same as that in the foregoing embodiment except for the fact that three sets of cop guide paths are provided. As shown in FIG. 29, in the terminal area 313, oblique slits 316 are formed between the partition walls 314 and the guide walls 315. And, on the bottom side of the slits 316, clippers 317 are provided so that they are always kept in operation during the running period of the feeder. The clippers 317 are provided so that, in this terminal area 313, yarns bridging the cops in the neighbouring paths or in a common path can be cut thereby. Such yarn bridges being formed by the spontaneous unwinding of the cop back winds during the travel of the cops along the path, and/or at the time when the cops are fed into the feeder. This cutting of the bridge yarn is effectuated at the moment when the bridge yarns fall into the slit 316.

Figure 30:
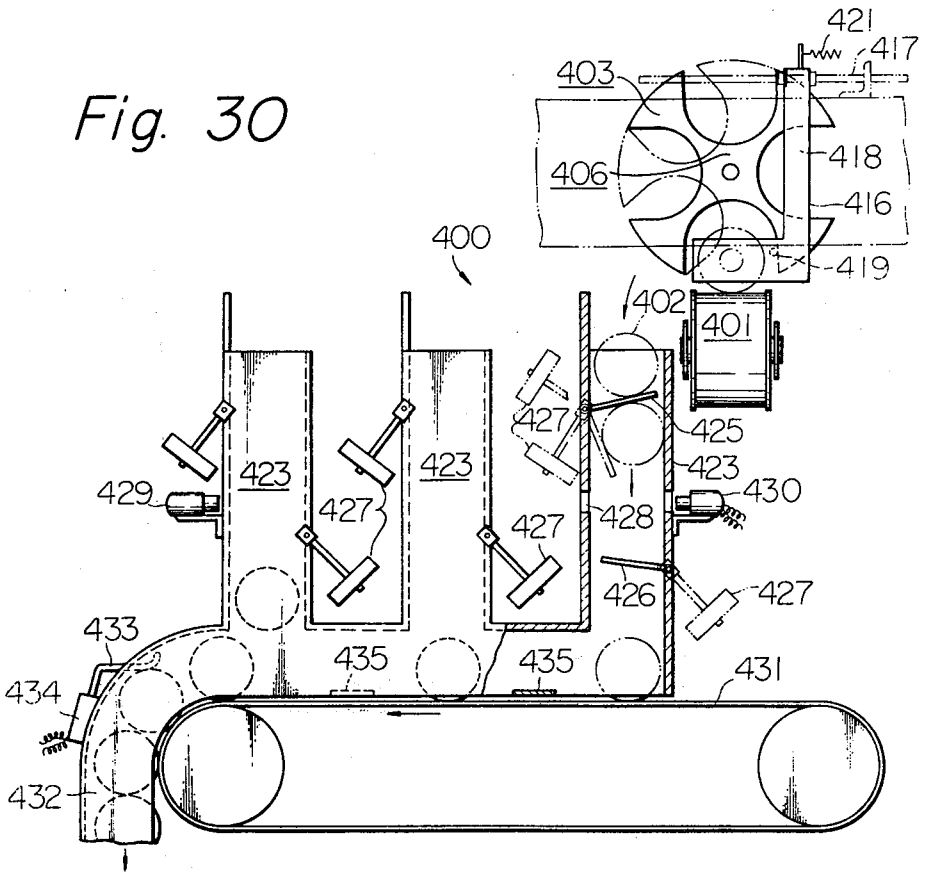
FIG. 30 is a side plane view of a partly cut-off conveyer assembly.
Figure 31:
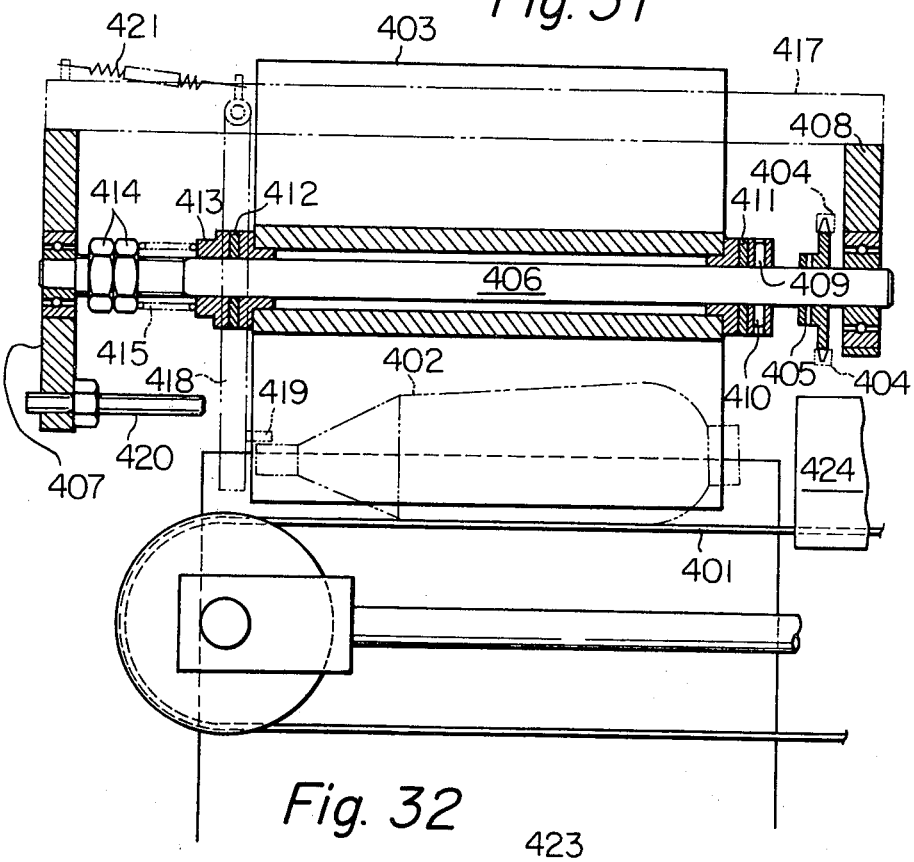
FIG. 31 is a vertical sectional plane view of the upper part of the conveyer assembly.
Figure 32:
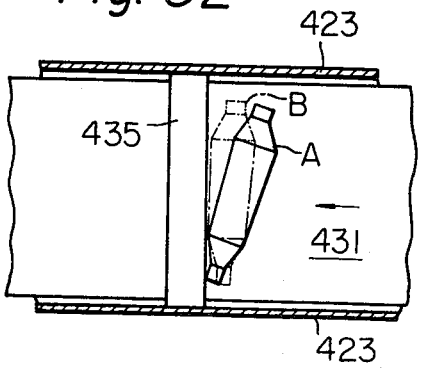
FIG. 32 is a top plane view of the arrangement for correcting the direction of the cops on the conveyer assembly.

In the case of this embodiment, the conveyer assembly 400 such as shown in FIGS. 30 to 32 substitutes itself for the chute 40 used in the foregoing embodiment. It transports the cops from the assembly 300 to the cop boxing assembly 500 while keeping their horizontal disposition.

Three sets of conveyers 401 are disposed below the outlet of the paths. The number of the conveyers corresponds to that of the paths defined by the partition walls 313 of the assembly 300. Over one end of the respective conveyor 401, a rotor 403 is disposed so as to drop the cop 402 off from the conveyer surface. The rotor 403 is mounted onto frameworks, 407 and 408 via a shaft 406 whose rotation is driven via a chain 404 and a sprocket 405. A fixed member 409 is secured onto the shaft 406 by a set screw 410. The rotor 403 is rotatably inserted over the shaft being accompanied by dutches 411 and 412 on both ends thereof.

The clutch 412 is always pushed rightwards in FIG. 31 by a spring 415 via a pushing disc 413 and a nut 414 mounted on the shaft 406. The rotor 403 is provided with peripheral recesses 416 which are receptive of the cops 402. Although four recesses are shown in the drawing, the desirable number of recesses can be formed on the rotor periphery. A stopper lever 418 is hung for free swinging from a supporting rod 417 mounted on frameworks 407 and 408. In a disposition hanging down in the vicinity of the end face of the rotor 403, a pin 419 disposed to the lower end of the stopper lever 418 positions inside of one of the peripheral recesses 416 of the rotor 403. A stopper 420 is secured to the framework 407 and a spring 421 is disposed, at its one end, to the supporting rod 417.

On one side of each conveyer 401, located right under the rotor 403, there is arranged a receiver chute 423 accompanied by a guide gutter 424. A pair of control plates 425 and 426 for controlling the lying condition of the cops are swingably pivoted on the inside wall of the chute 423, leaving a suitable vertical spacing between the two. Each control plate is so loaded by a weight 427 as to always tend to close the cop path through the chute 423. The number of the receiver chutes 423 corresponds to the number of the cop issuing paths of the cop sequencing device B. Each chute 423 is provided with two laterally opening light passable windows 428, and the windows of all the chutes are on one alignment. A light emitter 429 and a light receiver 430 are provided in such an arrangement that the emitted light can go through all the windows 428. The lower ends of the chutes 423 are open towards a lower conveyer belt 431 and the path of the cops formed between the belt and the openings is, on one end thereof, provided with a discharge outlet 432 to the cop boxing assembly 500. (see FIG. 30) A switch 434 accompanied with a feeler 433 is disposed to this discharge outlet 432, which switch 434 stops the operation of the cop boxing assembly 500 upon sensing of the absence of the cop. In a common plane, slightly above the surface level of the belt 431, multiple direction control plates 435 are located traversing the run of the belt in order to control the direction of the cops (See FIG. 32)

THE COP CONVEYER D

Figure 33:
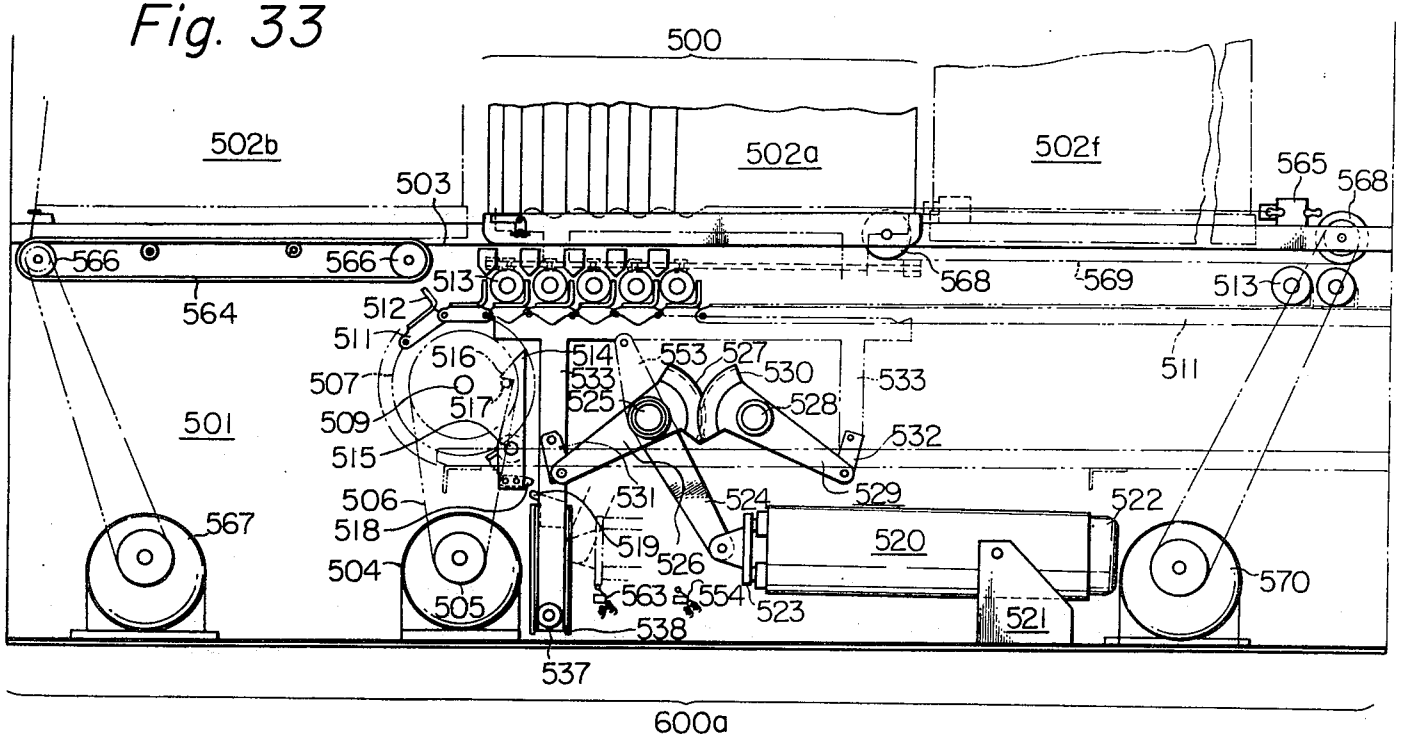
FIG. 33 is a vertical sectional plane view of a stand-by part on the cop boxing station.

The cop boxing assembly 500 is constructed in a cop storage part **600*a* of the cop boxing station 600 and they are explained together as follows, with reference to FIGS. 33 to 37. As shown in FIG. 33, a guide rail 503 is arranged on a machine framework 501, in order to introduce the containers 502 from leftward in the drawing. A drive motor 504 for the conveyer is located on the lower side of the framework, and this causes a counterclockwise rotation of a conveyer wheel 507 in FIG. 33 via a sprocket 505 having a friction clutch and a chain 506. The conveyer wheel 507 is fixed on a shaft 509, which is supported on the framework 501, together with a corresponding conveyer wheel (not shown) and both conveyer wheels are connected by an endless conveyer 511**.

The endless conveyer 511 is provided with multiple L-shaped lattices 512 distributed at equal distances over its entire outer surface. The lattices 512 serve for transporting the cops 513 towards the lower part of the container 502. A governer arm 514 is pivoted to a shaft 515 at its one end in such an arrangement that, in the normal situation, it stands almost upright as shown in FIG. 33. In this situation the upper end hook 516 of the governer arm 514 is in engagement with a pin 517, planted to one side of the conveyer wheel, in order to brake the rotation of the conveyer wheel 507. The arm 514 is provided with a projection 518 turnably disposed to its lower end. When this projection 518 is depressed downward by a pressor nose 519 of the later described push-up rod 533, the arm 514 turns clockwise in FIG. 33 about the shaft 515 and the pin 517 is disengaged from the hook 516, in order to result in one complete revolution of the conveyer wheel 507.

Figure 34:
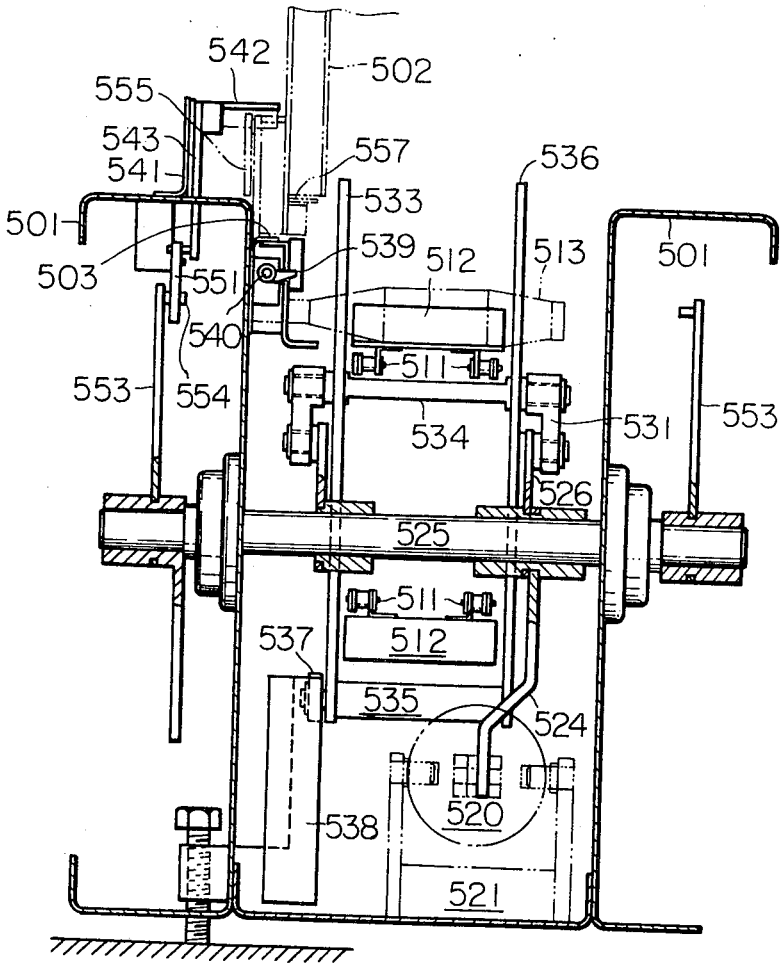
FIG. 34 is a front plane view of the stand-by part on the cop boxing station.

In the lower part of the machine framework 501, a screw cylinder 520 is turnably supported by a bracket 521, the front end 523 of which cylinder is forwarded and receded by the rotation of a motor 222 located behind the cylinder 520. By this movement of the front end 523, a shaft 525 fixed to a lever 524 is rotated. A turnable arm 526 is fixed to the shaft 525 and is provided, on its one end, with a sector gear 527 which stands in meshing engagement with a sector gear 530 of a turnable arm 529 fixed to a shaft 528. Therefore, through forwarding and receding movement of the front end 523 of the cylinder 520, both arms 526 and 529 carry out similar turning movements. Free ends of the turnable arms 526 and 529 are linked to push-up rods 533 via support segments 531 and 532, respectively. As shown in FIG. 34, push-up rods 536 are secured parallel to the push-up rods 533 by connecting rods 534 and 535. The pair of parallel rods 533 and 536 perform up-and-down movement together. The push-up rod 533 is provided, at its lower end, with a guide roll 537 in engagement with a guide block 538. The straight up-and-down movement of the rods 533 and 536 is guided by this guide block 538.

Below the guide rail 503, a stopper 539 is fixedly mounted on a shaft 540 and is kept at the disposition shown with solid lines in FIG. 34, being urged clockwise in the illustration by a certain spring (not shown). The stopper 539 therefore allows a smooth upward passage of the cops by its turning overcoming the spring force, but downward passage of the cops is hindered thereby.

An L-shaped rod 543 having a hook point 544 is pivoted to a support arm 541 over the upper face of the framework 501. The rod 543 is urged for clockwise turning in FIG. 35 by a spring 544, and is connected to a hook 546 by a connecting rod 545. A damper spring 547 is inserted over the rod 545 for the hook 546. A hook 551, having a hook point 550, is pivoted to a branch arm 548 in an arrangement being always urged clockwise in the drawing by a spring 549. The hook point 550 is put in an engagement with a pin 552 of an L-shaped lever 543. The lower end of the hook 551 engages with a pin 554 of a turnable arm 553 pivoted to the shaft 525. An L-shaped lever 555 is urged for a clockwise turning by a spring (not shown), and its forked end 556 is in an engagement with a pin 558 of a closure member 557 which is located under the container 502. By turning the L-shaped lever 555, the bottom of the container 502 is opened or closed for issue and encasement of the cops. A stopper 560 is disposed to the support arm 541 being urged clockwise in FIG. 36 by a spring 559. This stopper 560 engages with a projection 561 formed on the side face of the lower part of the container, in order to fix the container 502 on its position of stop. A contact switch 563 is closed through contact with the front end 523 of the cylinder 520 when the cylinder 520 is on the forwarded position thereof.

In the arrangement shown in FIG. 33, a container let-off belt 564 and a container pusher rod 565 are provided near both ends of the cop boxing assembly 500. The container let-off belt 564 runs over pulleys 566 being driven by a drive motor 567. The container pusher rod 565 is mounted on a pair of parallel chains 569 which run over sprockets 568 being driven by a drive motor 570.

Figure 37:
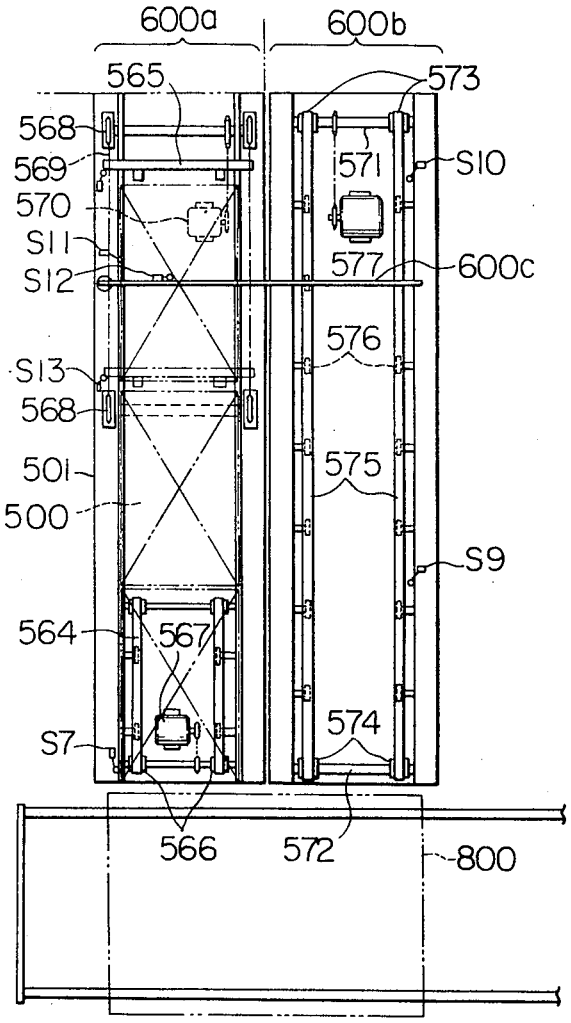
FIG. 37 is a top plane view of the cop boxing station.

Referring to FIG. 37, the container reception part **600*b* of the cop boxing station 600 includes a pair of conveyor belts 575 which run over pulleys 573 and 574 mounted on a pair of vertically spaced horizontal shafts 571 and 572. Along the run of the belts, supporter rolls 576 are provided in order to support the belts 576. Circulation of the belts 575 is actuated by a drive motor 577.**

Figure 38:
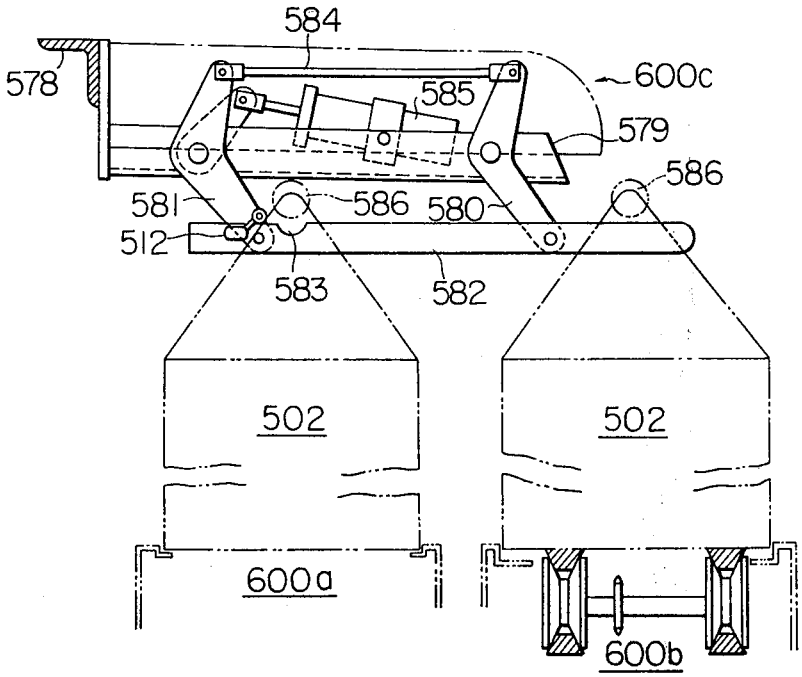
FIG. 38 is a front plane view of the arrangement for shifting the container position on the cop boxing station.
Figure 39:
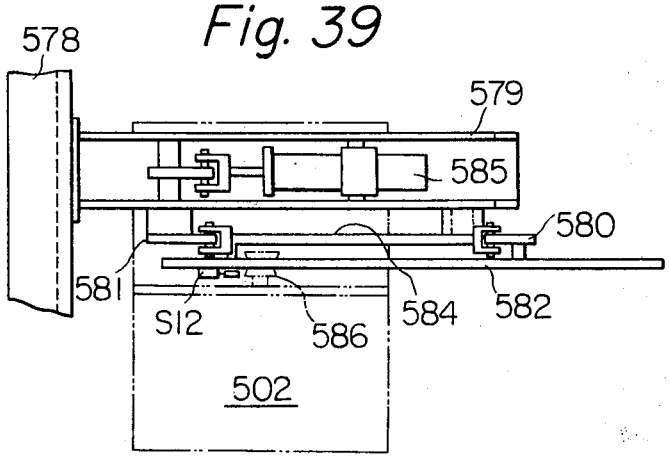
FIG. 39 is a top plane view of an arrangement for shifting the container position on the cop boxing station.
Figure 40:
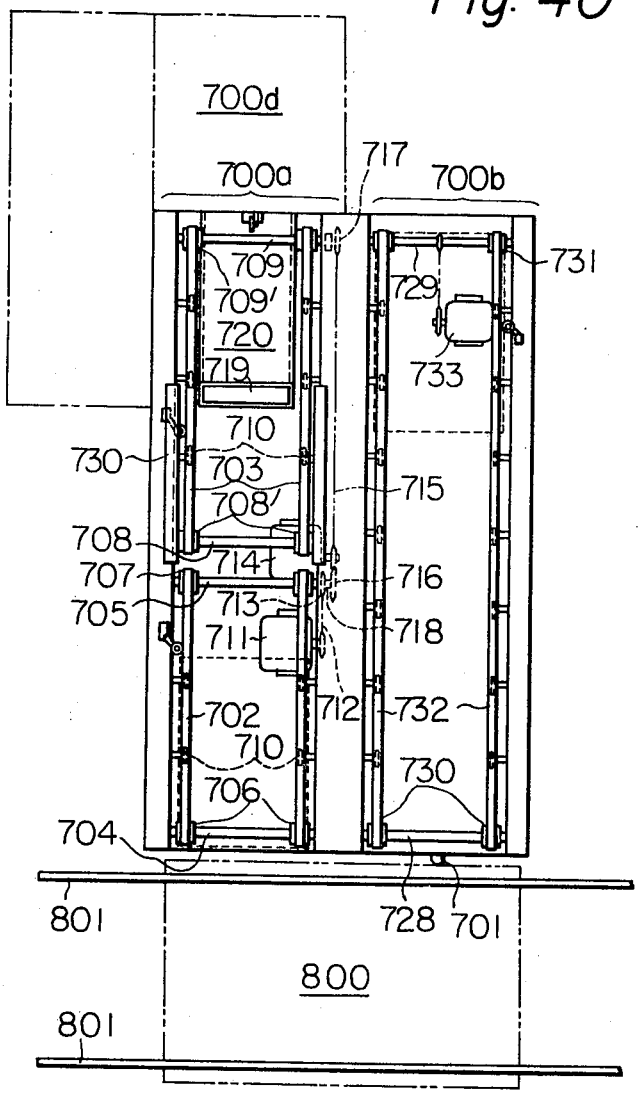
FIG. 40 is a top plane view of the supply station.
Figure 41:
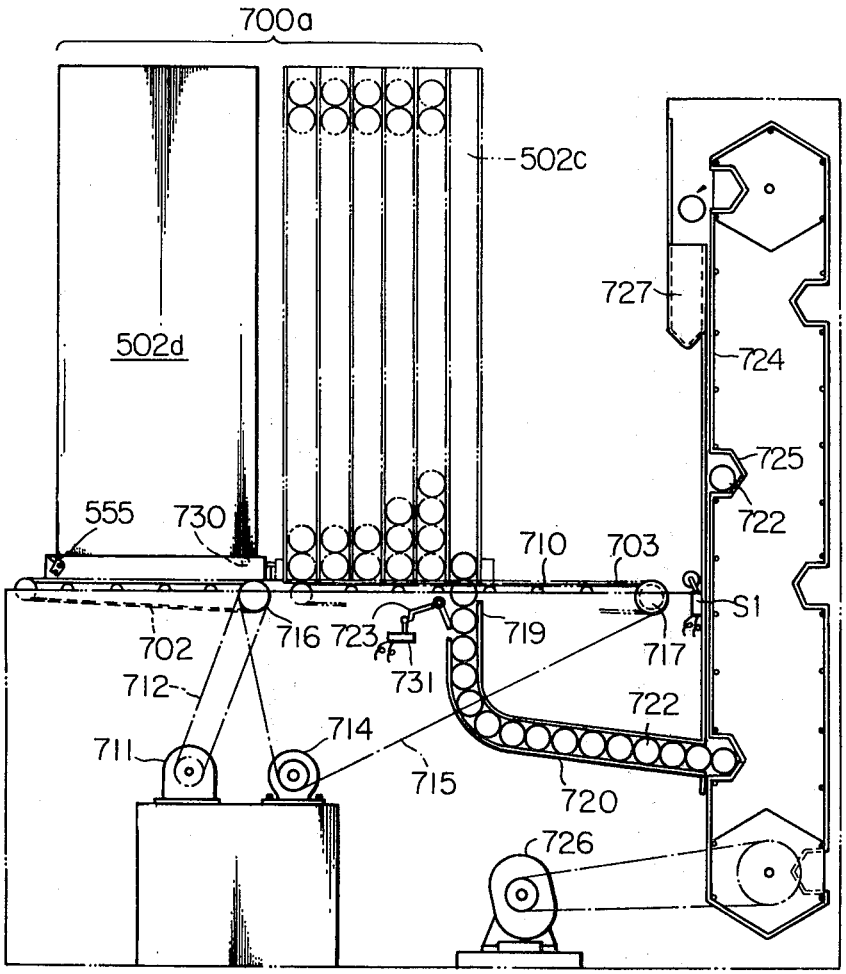
FIG. 41 is a side plane view of a partly cut-off arrangement for reception of new container on the supply station.

The container displacer part **600*c* of the cop boxing station 600 is located over the cop storage part 600*a* and the container reception part 600*b* as shown in FIGS. 38 and 39. A pair of curved arms 580 and 581 of a similar shape are pivoted at their apexes to a support arm 579 disposed to a machine framework 578. This is in order to hold a container holder rod 582 pivoted to the lower ends of the arms 580 and 581. The holder rod 582 is provided with an upper recess 583 at a position just above the center of the cop storage part 600*a*. The pair of curved arms 580 and 581 are connected at their upper ends by a connecting rod 584. A fluid cylinder 585 is provided also in order to actuate swinging movement of the curved arms 580 and 581. Pulleys 586 are provided also in order to hoist the containers 502.**

The arrangement of the supply station 700 is seen from FIGS. 18 and 40 to 44. Wherein, the structure of this part is almost the same as that of the cop boxing station 600 while including: a new container reception part **700*a*; a bare container let-off part 700*b*; a container replacer part 700*c*, and; a new cop conveyer part 700*d*.**

The new container reception part **700*a* is provided with two pairs of conveyer belts 702 and 703 on its upper surface. The belts 702 are carried by pulleys 706 and 707 mounted on shafts 704 and 705, respectively. The belts 703 are similarly carried by pulleys on the shafts 708 and 709. The belts are accompanied with supporter rolls 710. Circulation of the conveyer belt 702 is actuated by a drive motor 711 via a chain 712, a sprocket 713 and the shaft 705. Whereas rotation of a drive motor 714 causes corresponding travel of the belt 703 via a chain 715, a sprocket 716 mounted on the shaft 705, a sprocket 717 and the shaft 709.**

The sprockets 713 and 716 are accompanied with a one-way clutch 718 so that, when the drive motor 714 rotates, the sprockets 716 and 717, i.e. the shafts 705 and 709, are actuated for rotation via the chain 715. Whereas, upon rotation of the motor 711, only the sprocket 713 is rotated via the sprocket 712 in order to actuate the shaft 705 for rotation. In the latter case, the sprocket 716 remains still. Cops 722 are supplied into an opening 719 of a cop chute 720 from a container **502*c* standing by over the chute. The presence of the cops is sensed by a feeler mechanism 723 which is always urged clockwise in the drawing. So long as this feeler mechanism 723** is in contact with the cop, the switch is kept open.

The new cop conveyer part **700*d* includes a vertical lattice 724 for receiving cops from the cop chute 720. This lattice 724 is driven for circulation by a drive motor 726 and is provided with multiple buckets 725 formed thereon being spaced from each other. A cop throw-out chute 727 is formed relative to the upper end of the run of the lattice 724, and the direction of the cops is put in order in the vicinity of this chute 727 (see FIG. 41**)

Figure 44:
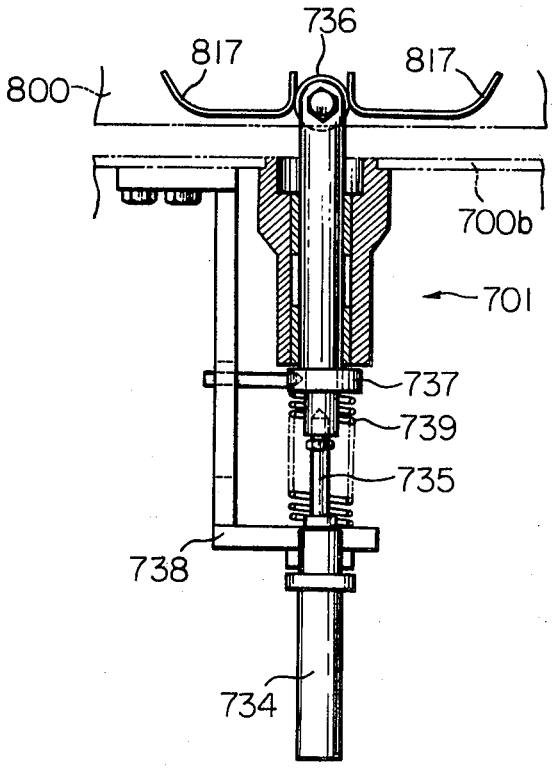
FIG. 44 is a sectional plane view of a positioning mechanism.
Figure 45:
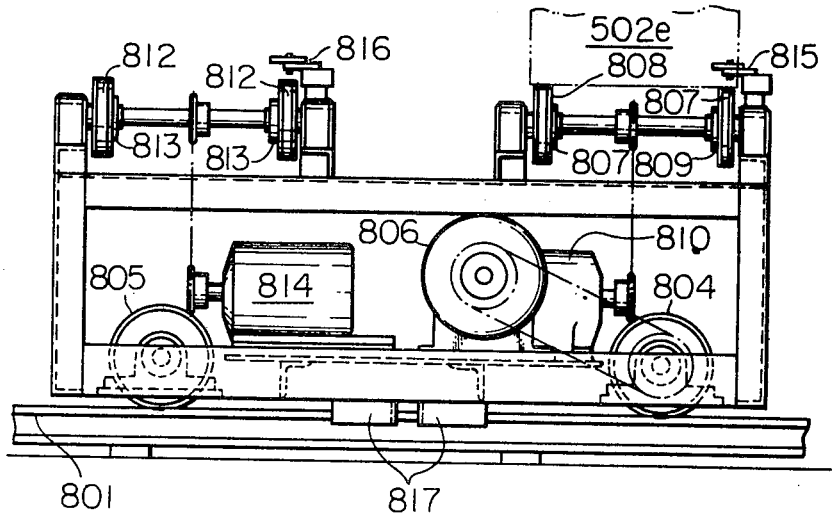
FIG. 45 is a back plane view of the traverse assembly.
Figure 46:
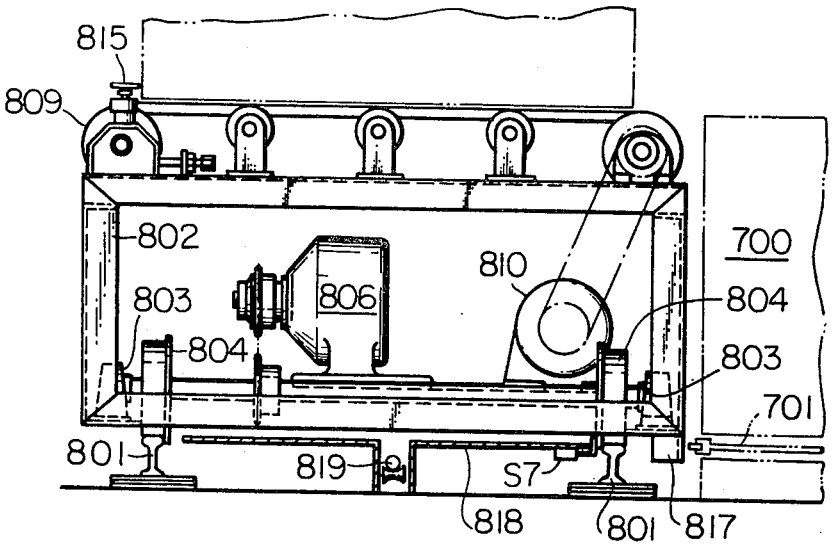
FIG. 46 is a side plane view of the traverse assembly.
Figure 47:
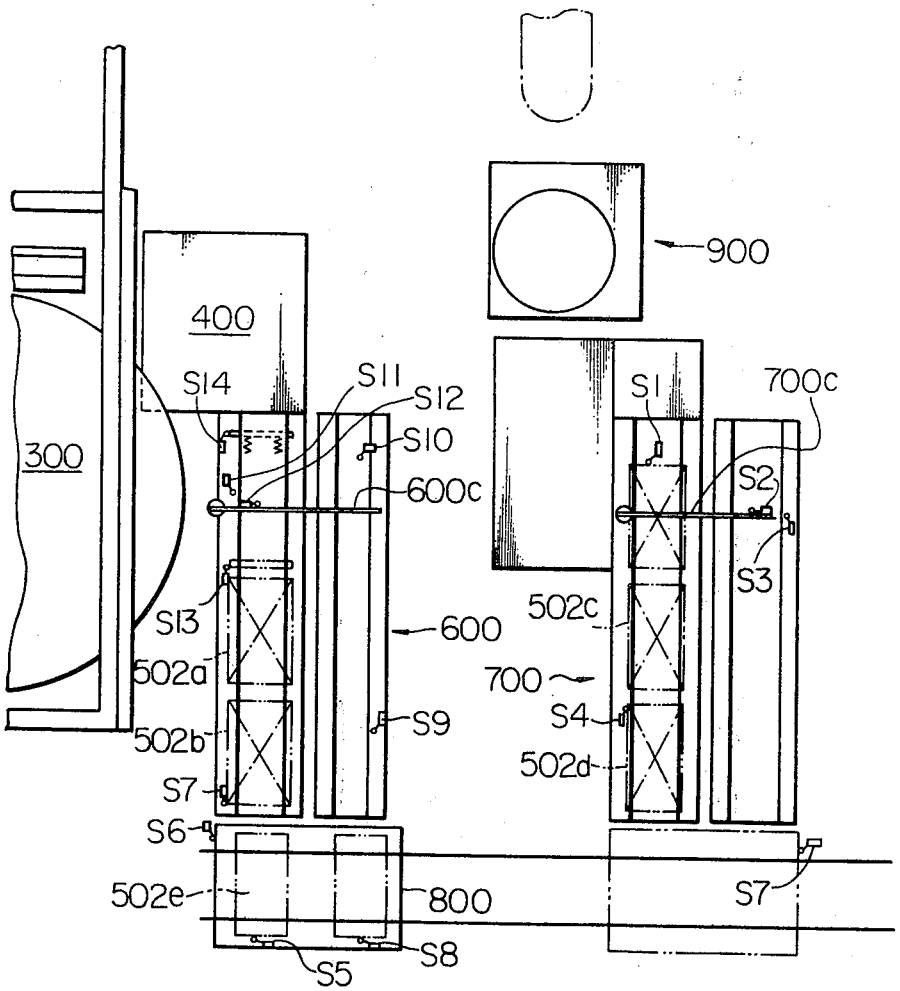
FIG. 47 represents the entire structure of the apparatus, and, FIGS. 48 to 53 represent the structure and operational condition of the cop direction controlling assembly.
Figure 48:
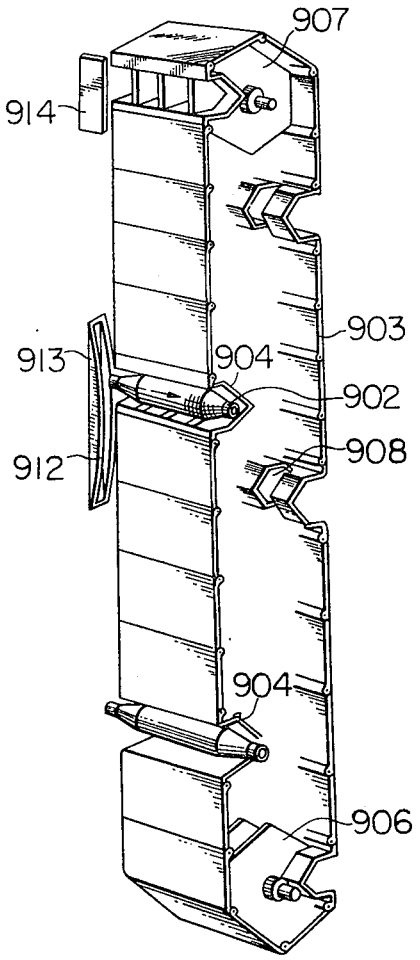
Figure 49:
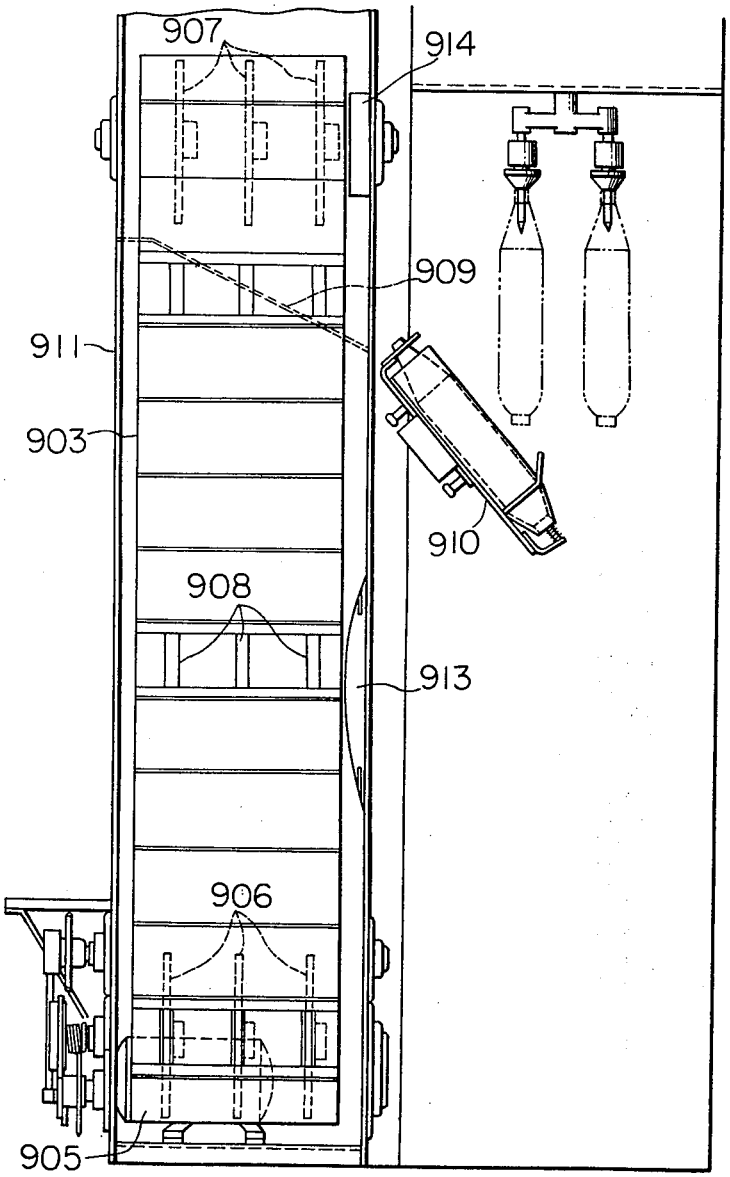
Figure 50:
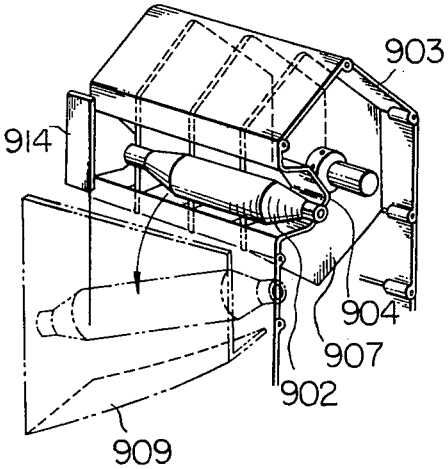
Figure 51:
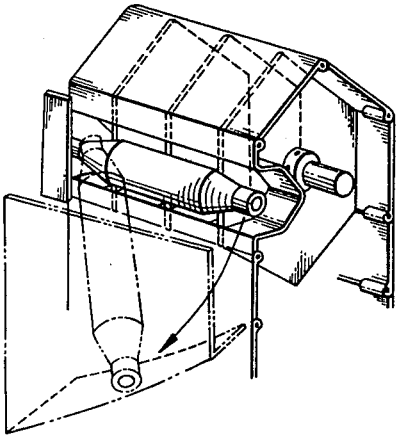

The empty container let-off part 700b includes a pair of horizontal belts 732 and 733 running over pulleys 730 and 731, which are mounted on a pair of shafts 728 and 729, respectively. Circulation of the belt 732 and 733 is caused through rotation of the shaft 729 by a drive motor 733. A positioner assembly 701 of the traversing assembly is located on the traversing side of the arrangement. As shown in FIG. 44, the positioner assembly 701 includes: an air cylinder 734; a piston rod 735 of the air cylinder; a roller 736 disposed to the outer end of the rod; a flange 737 formed on the body of the rod, and; a spring 739 inserted in between the flange 737 and a supporting frame 738. Upon discharge of air from the cylinder 734, the piston rod 735 is pushed forward i.e. outwards. In the drawing, the traverse assembly 800 is provided with cams 817.

Figure 42:
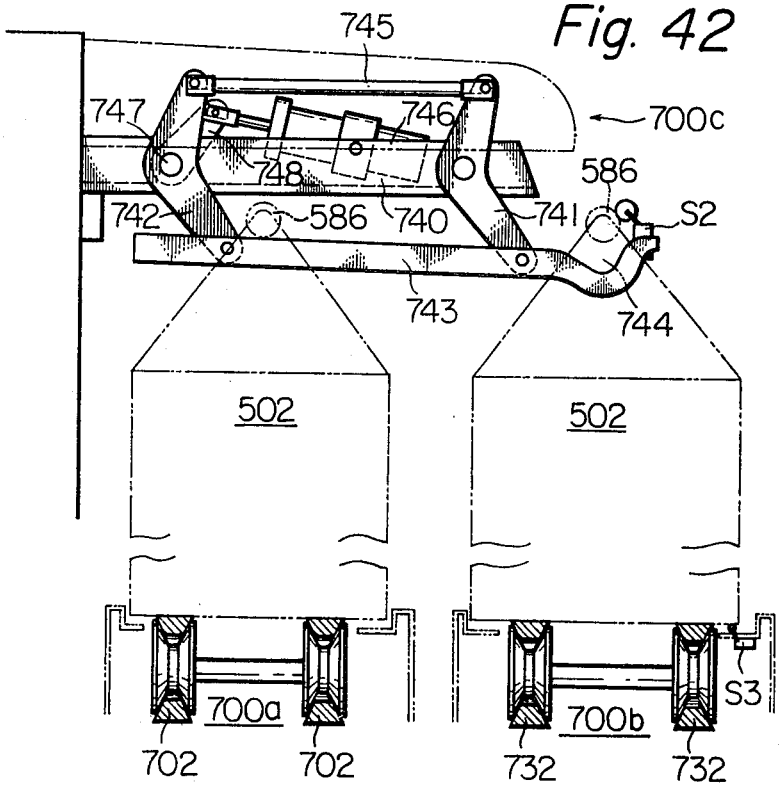
FIG. 42 is a front plane view of an arrangement for shifting the container position of the supply station.
Figure 43:
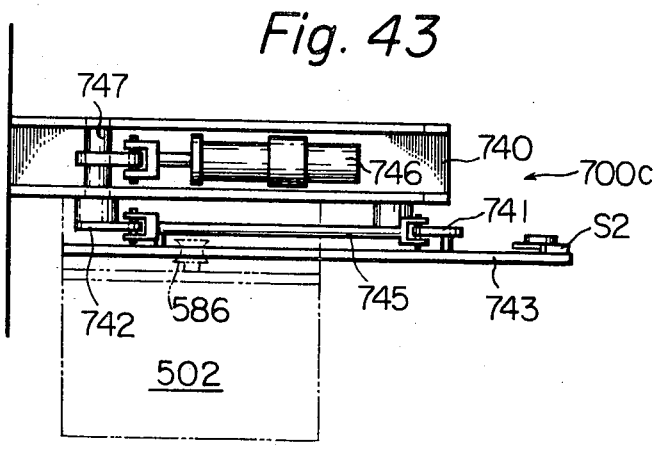
FIG. 43 is a top plane view of the arrangement shown in FIG. 42.

The structure of the container replacer part **700*c* of the supply station 700 is almost the same as the container replacer part 600*c* of the cop boxing station 600. As shown in FIGS. 42 and 43, the replacer part 700*c* is located spreading over the new container reception part 700*a* and the empty container let-off part 700*b*. A holder rod 743 is disposed to lower ends of a pair of curved arms 741 and 742 swingably pivoted to a support arm 740. The holder rod 743 is provided with an upper recess 744 at a position right above the center of the empty container let-off part 700***b*. Upper ends of the curved arms 741 and 742 are connected to each other by a connecting rod 745. For swinging of the arms 741 and 742, a fluid cylinder 746 and an operator arm 748 pivoted to a pin 747 on the arm 742 are provided.

As shown in FIGS. 18 and 45 to 47, the traverse assembly 800 is placed for reciprocal movement on rails 801 installed in front of the cop boxing and supply stations 600 and 700. Wheels 804 and 805 are mounted on a machining framework 802 via bearings 803 and the wheel 804 is driven from rotation by a drive motor 806. A belt 807 is driven for circulation by a drive motor 810 running over a pair of pulleys 808 and 809. Similarly, belts 812 run over pulleys 813 being driven by a drive motor 814. A pair of stoppers 815 and 816 are provided in order to control the positions of the containers. On the lower side of the framework, there is provided cams 817 which stand in engagement with the positioner assembly 701 of the supply station 700 when the latter extrudes. The floor under the arrangement is covered by a cover plate 818 and a cable 819 runs through an elongated space defined by the plate in order to effect the supply of electric service and signals to the traveller.

THE COP DIRECTION CONTROLLER C

The cop direction controller assembly 900 is located side by side to the new cop conveyer part 700*d* in a form such as shown in FIGS. 48 to 53. The vertical lattice 903 runs over a pair of rotary guides 906 and 907, being driven by a drive motor 905. At equal intervals, transverse buckets 904 are formed on the lattice 903, and each bucket 904 is provided with several slits 908 for a traveling engagement with the rotary guides 906 and 907. Near the upper end of the lattice rung, there is provided a guide chute 909 for the cops thrown out from the buckets 904. The guide chute 909 is downstreamly accompanied by a cop receiver 910 for reception of cops falling down along the chute 909.

Figure 52:
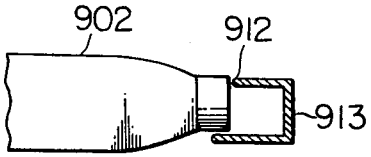
Figure 53:
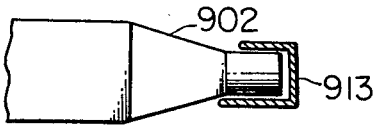

An engaging member 913, having dull curved faces 912, is mounted on a mantle wall surrounding the lattice 903 at a position engageable with cops carried by the lattice 903. The size of the gap of the engaging member 913 is so selected that only the cop heads are permitted to pass therethrough quite freely. But free passage of the cop tails is hindered by the engaging member 913. Therefore, when a cop arrives at the position of this member 913 with its head of smaller diameter being on the side of the gap as shown in FIG. 53, the passage of the cop is not disturbed at all. On the other hand, when the cop tail is on the side of the gap of the engaging member 913 as shown in FIG. 52, the cop is pushed leftwards through contact of the tail with the curved faces 912. At a position on the wall 911, over the engaging member 913, a governer block 914 is fixed. Projection of the governer block 914 into the path of the carried cops is so selected that the cops that have passed the engaging member 913 without hindrance will come in contact therewith. But the cops hindered and pushed by the engaging member 913 will pass by the governer block 914 without contact. The falling direction of the cops is regulated as above-described by the combined function of the engaging member 913 with the governer block 914.

Due to the circulation of the vertical lattice 903, the cops are carried upwards being held, in the respective buckets 904. When the cop tail is situated on the right side in FIG. 49, the cop is pushed leftwards, as shown in FIG. 52, through contact with the curved faces 912 of the engaging member 913 as the cop passes by the latter. After being leftwardly displaced in this way, the cop approaches the upper end of the run of the lattice and is thrown out into the guide chute 909, without any engagement with the governer block 914. On the other hand, when the cop head is located on the right in FIG. 49, the cop freely passes through the engaging member 913 as shown in FIG. 53 and, upon arrival at the position of the upper rotary guide 907, the cop head comes in contact with the governer block 914. The cop then falls down into the guide chute 909 with its tail being directed downwards.

The cops falling down along the guide chute 909 are once received by the cop receiver 910 and transferred to the automatic winder. Because the cop direction controller C of the present embodiment is made up of the stationary disposed engaging member 913 and governer block 914, a reliable operation thereof can be expected in comparison with the one employed in the structure of the preceding embodiment of the present invention.

The correlated operation of the entire arrangement of the present embodiment of the present invention is as follows.

When the cops in a bobbin feeder 307 of the assembly 300 are almost consumed, the feeler lever 226 senses this situation and sends a corresponding instruction signal to the drive motor 209 for starting of the latter. Upon starting of the drive motor 209, the endless chain 208 starts its circulation. Following this, the bucket 210 of the chain 208 kept in the position I, shown with solid lines in FIG. 24, move towards the position II. And, upon arrival at this position, it kicks the switch 224 in order to stop the running of the drive motor 209, and it at once stands still at that position II. At this moment, the drawer hook 126 of the cop container positions just within the cut-out 219 of the bucket 210, and the point of the hook 126 can lock the cop container placed within the bucket 210.

Figure 19:
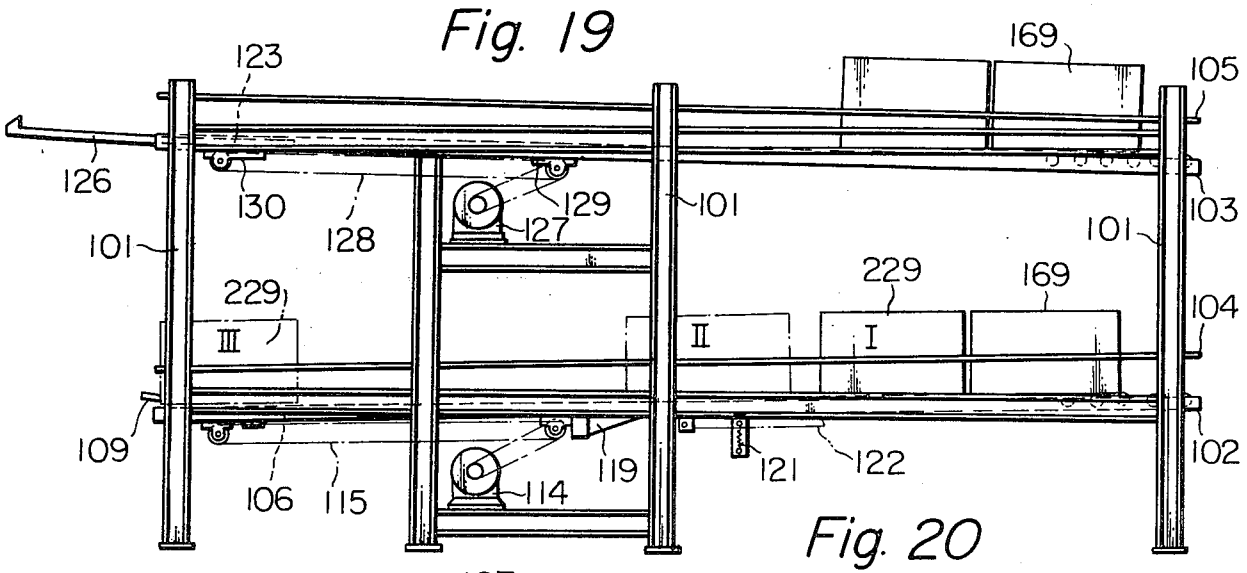
FIG. 19 is a side plane view of a cop container aligning mechanism.
Figure 20:
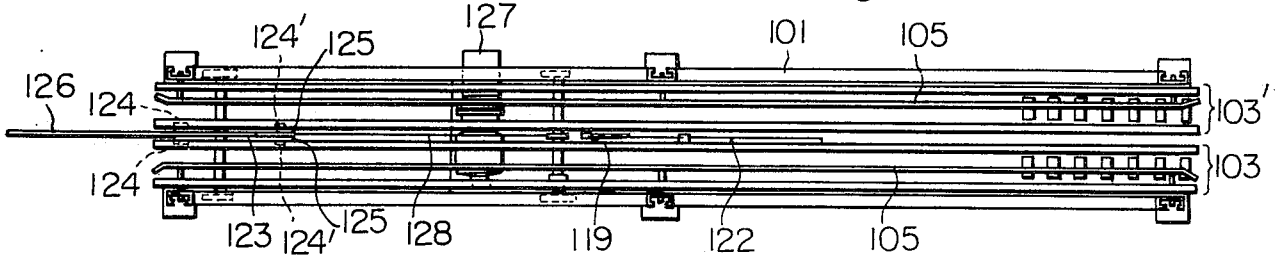
FIG. 20 is a top plane view of the cop container aligning mechanism.

When the switch 224 is kicked by the bucket 210, the motor 127 starts its running simultaneously and the drawer assembly 123 moves rightwards in FIGS. 19 and 20. By this movement, the drawer hook 126 is forced into engagement with the bottom of the cop container 229. The empty cop container 229 in the bucket 210 is pulled out of the bucket 210 passing over the roller conveyers 214*a* and 214'*a*, which are located at somewhat raised level on the termination of the roller conveyers 214 and 214'. The empty cop container 229 so pulled out is placed on the upper roller conveyers 103 and 103'. As the chain 128 circulates, the drawer assembly 123 kicks the switch 129 and the motor 127 is de-energized. The empty cop container 229 slides down along the roller conveyers 103 and 103' automatically because the latter is inclined.

Concurrently with the stopping of the running of the motor 127 by the de-energization, the other motor 209 starts its running in order to lower the bucket 210 to the position III shown in FIG. 24. At the end of this lowering, the switch 225 is depressed by the bucket 210 and the motor 209 is deenergized for stopping. Accordingly, the bucket 210 at once stands still at this position III. Simultaneously with this, the other motor 114 starts running in order to carry the pusher assembly 106 leftwards in FIGS. 18, 21 and 22 via the chain 115. In the initial disposition, the pusher assembly 106 assumes the position I shown in FIG. 21. That is, the sideway roll 107 of the pusher assembly 106 rides on the sector cam 119 and turns it clockwisely. Owing to this, the bent lever 122 linked to the sector cam 119 turns counterclockwise while overcoming the resilient force of the spring 121 and the end of the lever 122 projects above the level of the roller coneyer 102 and 102'. The end of the lever 122 so projected is brought into engagement with the cop container 229 full of new cops so that the latter is held still at the first stop position in FIG. 19.

In this disposition, the bucket 210 is guided to a position corresponding to the ends of the roller conveyers 102 and 102' as already explained, and kicks the switch 225 so that the motor 114 is energized for running. By this running of the motor 114, the pusher assembly 106 travels leftwards in FIGS. 19, 21 and 22, and the sideway rolls 107 of the assembly 106 are released from engagement with the sector cam 119. By the resilient force of the spring 121, the bent lever 122 is turned clockwisely while the sector cam 119 is turned counterclockwisely. Especially, the sector cam 119 places its part 119' over the level of the roller coneyers 102 and 102'. Due to this, the cop container 229 retained in the first stop position in FIGS. 19, 21 and 22, slides down leftwardly until it stops at the second stop position II through abutment with the projecting part 119' of the sector cam 119.

Figure 21:
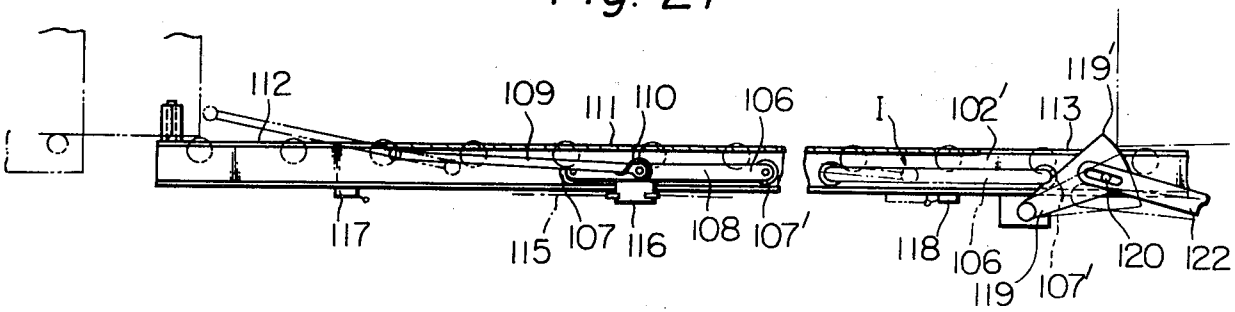
FIG. 21 is an enlarged side view of a part of a conveyer assembly.
Figure 22:
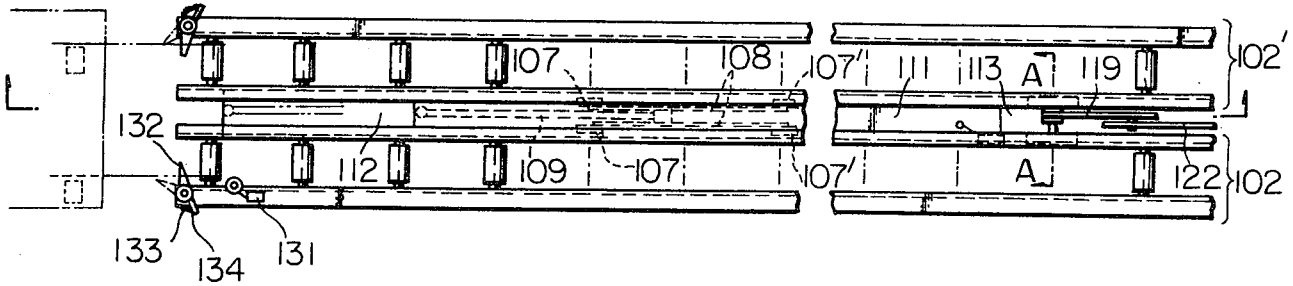
FIG. 22 is a top plane view of the part of the conveyer assembly.
Figure 23:
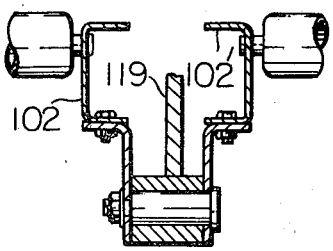
FIG. 23 is a sectional plane view taken along the line A—A in FIG. 22.

On the other hand, as the pusher assembly 106 displaces leftwards in FIGS. 19, 21 and 22, the end of the pusher rod 109 is disengaged from the upper cover 111 and is pushed up into the elongated opening 112, due to the resilient force of the spring 10. By this action the end of pusher rod 110. forces the cop container 229, resting at the third stop position III (see FIG. 19), to slide into the bucket resting at the position III in FIG. 24. Meanwhile, the pusher assembly 106 moves till the foremost position in FIG. 21, kicks the switch 117 and reverses its direction of movement. Simultaneously the drive motor 209 of the container overturning mechanism 200 starts its running in order to lift the bucket with the new container off from the position III.

Upon arrival at the rearmost position, the pusher assembly 106 induces a clockwise turning of the sector cam 119 by the sideway rolls 107'. And the part 119' of the cam 119 is made to sink below the level of the roller conveyers 102 and 102'. Following this, the cop container 229, at the position II in FIG. 19, is released from the engagement with the part 119' of the cam 119 and slides down along the inclined roller conveyers 102 and 102' leftwards until it collides against the stopper 132. The clockwise turning tendency of the stopper 132 being urged by the spring 133 is restrained by the stop pin 134. Although the collision with the cop container does not cause counterclockwise turning of the stopper 132, the pushing by the pusher assembly 106 causes a corresponding counterclockwise turning of the stopper 132 overcoming the spring 133 for a free passage of the cop container.

As above-mentioned, the sector cam performs the clockwise turning being pushed by the sideway roll 107'. The bent lever 122 also turns counterclockwise as the container moves from the position II to III in FIG. 19 and the end thereof is projected over the level of the roller conveyers 102 and 102' in order to stop the next container 229 at the position I.

After being lifted from the position III in FIG. 24, the bucket 210 moves leftwards from the position of the sprocket 204 and further moves downwards at the position of the sprocket 205. This lowering of the bucket 210 is hindered by the engagement of the roll 212 with the guide rail 211. However, as the shaft 213 of the bucket 210, secured to the endless chain 208, continues its movement with the chain 208, the bucket 210 is fully overturned at the position IV in FIG. 24 so as to throw off cops into the bobbin feeder 307 located just under the container in that position. Meanwhile the endless chain 208 continuously carries on its movement until it kicks the switch 223 at the position V in FIG. 24 in order to actuate a timer not shown. At a prescribed time point, the timer functions so as to stop the electric service to the drive motor 209. In the present embodiment, setting of this timer is designed in view of the length of the time until the moment whereupon the bucket 210 reaches the position I in FIG. 24. Therefore, after kicking the switch at the position V, the bucket 210 is automatically brought to the position I and stands still there while carrying the empty cop container inside. This is the stand-by position of the bucket for the next cycle of traveling.

When the switch 223 is kicked, not only the timer but also the drawer assembly 123 of the cop container aligning mechanism 100 is actuated for operation. Initially, the drawer assembly 123 stands still at the rearmost position whereat it has kicked the switch 129 for drawing-in of the cop container. Upon the actuation by the depressing of the switch 223, the assembly 123 starts to move leftwards in FIGS. 19 and 20 until it presses the switch 130 at a position whereon the drawer hook 126 is most extruded. This is the stand-by position of the drawer assembly 123.

When the cops are fed into the feeder 307, and the cop boxing assembly 500 carries out the cop boxing operation, pulsating electric current flows in the coil of the assembly 300. This is in order to issue the cops through the terminal area 313 thereof by utilizing the high frequency vibration of the feeder 307 caused by the coil energization.

The cops so issued are further transported by the conveyer 401 of the conveyer assembly 400. When the shaft 406 is rotated by the chain 404 via the sprocket 405, the rotor 403 tends to co-rotate therewith. However, as the pin 419 of the stopper lever 418 is in engagement with the recess 416 of the rotor 403, the rotor 403 does not co-rotate but slides relative to the clutches 411 and 412. Thus overcoming the pressure by the pushing disc 413 depressed by the spring force of the spring 415. When the cop 402 is brought into the recess 416 of the rotor 403 as shown in FIG. 31 by the conveyer 401 from the guide gutter 424, the end of the cop 402 collides against the stop lever 418 so as to turn it clockwise in FIG. 31. Thereby, the pin 419 is released from the engagement with the recess 416 of the rotor 403. Upon this cancellation of the engagement, the rotor 403 is rotated over one-fourth of a revolution in the clockwise direction in FIG. 30 so that the cop 402 is discharged down into the receiver chute 423. Inside the chute 423, the path of the cops is closed by the control plates 425 and 426, associated by the weight 427. The cop 402 falling down is, therefore, placed on the conveyer belt 431 with its horizontal disposition being controlled by the plates 425 and 426.

As the belt 431 circulates, the cops on the belt comes in contact with the direction control plate 435. When the cop is inclined about the width direction of the belt as indicated by A in FIG. 32, the direction is corrected as indicated by B through contact with the plate 435 and is pushed forward passing over the plate 436 by the succeeding cop. Thus the cops are discharged in the right direction through the discharge outlet 432 over the endless conveyer of the cop boxing assembly 500.

The receiver chutes 423 are accompanied with the light emitter 429 and the light receiver 430. And, when the light beam across the chutes is intercepted for an appreciable length of time, that is the cops are stagnated inside the chutes, supply of the cops is stopped. The switch 434 is located near the discharge outlet 432 of the chute 423 and, when the feeler 433 of this switch does not sense the cop, the operation of the cop boxing assembly 500 is stopped. With this control of the feed rate of the cops, the cop is discharged from the outlet 432 over the endless conveyer 511 and, as the conveyer 511 travels, is supplied to the next stage on the right-hand end in the arrangement shown in FIG. 33. During the off-working period, the push-up rods 533 and 536 stand still in the disposition shown with solid lines in FIG. 33. Although the drive motor 504 is always running, the sprocket 505 rotates without any operation because of the engagement of the governer arm 514 with the pin 517 and the endless conveyer 511 stands still.

When the boxing instruction is issued as later explained, the motor 522 of the screw cylinder 520 starts its running. Its front end 523 advances leftwards in FIG. 33 in order to cause the turning of the arms 526 and 529 via the lever 524 and the shaft 525. By this turning, the rods 533 and 536 are lifted so that the all cops 513 on the conveyer 511 are pushed-up. As the cops so pushed-up pass by the position of the stopper 539 shown in FIG. 34, the front end 523 of the cylinder 520 pushes the switch 554 and the rods 533 and 536 descend. During this lowering movement of the rod 533, the presser nose 519 accompanying the rod presses the projection 518 so as to cancel the engagement of the arm 514 with the pin 517, thereby the conveyer wheel 507 is rotated over one revolution being driven by the sprocket 505. Meanwhile, the engagement of the arm 514 with the pin 517 is revived so that the conveyer wheel 507 ceases its rotation after the one complete revolution. By this one complete revolution of the wheel, the conveyer moves until the subsequent cops are brought under the container 502. Following this, the motor 522 restarts its running in order to repeat the above-described sequence of operation.

In this manner, the prescribed number of cops are successively encased into the container 502. After the prescribed number of startings of the motor 522 have been registered in a counter, the front end 523 reaches the position shown with chain-and-dot lines in FIG. 33 on its last time of advance and lets the arms 526 and 529 turn by a great deal. Due to this turning, rods 533 and 536 are lifted to the position shown with chain-and-dot lines in FIG. 33, i.e. the position shown with solid lines, in order to place all the cops within the cop container.

Figure 35:
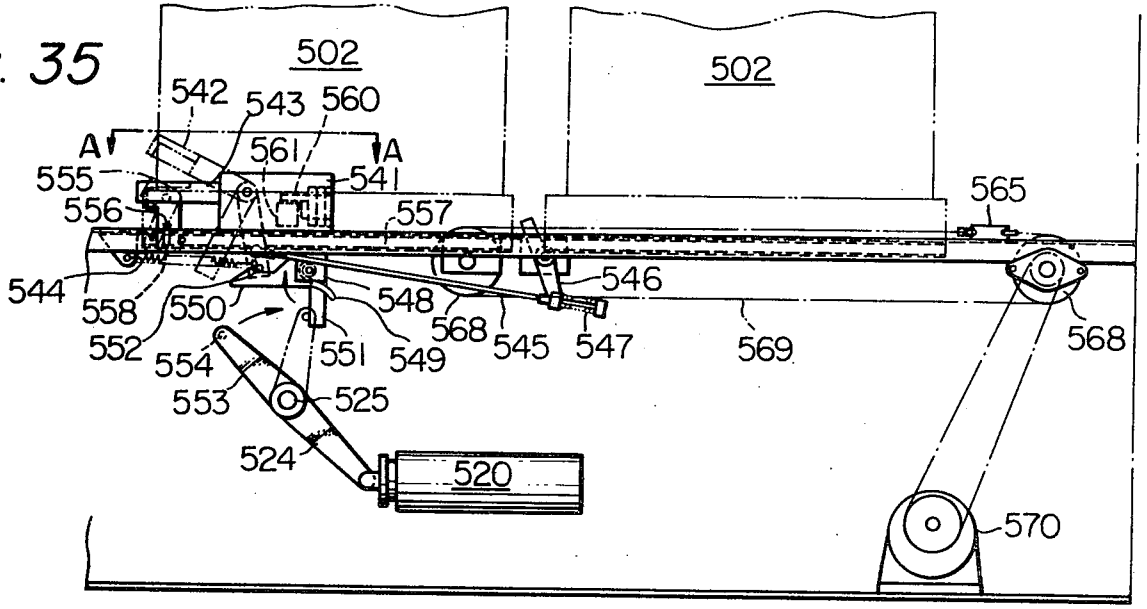
FIG. 35 is an enlarged side plane view of a part of the cop boxing station.
Figure 36:
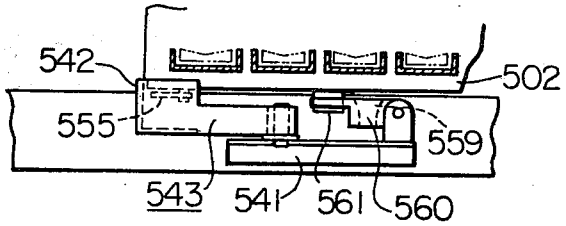
FIG. 36 is a top plane view seen along the line A—A in FIG. 35.

On the other hand, concurrently, the pin 554 of the arm 553 forces the hook 551 to turn counterclockwise in FIG. 35 overcoming the resistance by the spring 549 and the engagement of the hook point 550 with the L-shaped rod 543 is cancelled. Thereby the latter is turned clockwise in FIG. 35 so as to remove the pressure on the L-shaped lever 555. Then the L-shaped lever turns in the clockwise direction as shown with chain-and-dot lines in FIG. 35 and the closure member 557 is moved leftwards due to its connection 556 and 558. The closure member 557 so moved closes the path of the container 502 so that the cops are fully and completely encased within the container.

After the above-described encasement of the cops, the container 502 assumes the position **502*a* in FIG. 33 and the preceding container full of the cops is located on the position 502*b***.

The empty container let-off part **700*b* of the supply station supplies new cops to the automatic winder E upon receipt of requirement signals from the latter. At every request by the automatic winder E, the drive motor 726 starts running in order to lift the bucket 725 of the vertical lattice 724. After orientation by the cop direction controlling assembly 900, cops 722 are fed to the automatic winder E. New cops 722 are supplied from the container 502*c* on the new container reception part 700*a*. The container 502*c* is placed on the conveyer belt 703 of the new container reception part 700*a*. The L-shaped lever 555** is turned by the container open cam and the closure segment of it is kept open.

The first section of the container interior space is located just over the opening 719 and the cops 722 are supplied over the conveyer via the guide chute. When the cops in the first section of the container **502*c* are almost consumed, the feeler mechanism turns clockwise, the contact of the switch is closed and the drive motor 714 is started for running. Then the conveyer belt 703 is moved so that the second section of the container 502*c* comes just over the opening 719** and the cops are supplied from the section into the guide chute.

After repetition of this procedure, cops in the last section are discharged and the empty container **502*c* moves further in order to press the switch $S_1$. At this moment, the pulley 586 of the container 502 is positioned over the holder rod 743 of the container replacer part 700*c*. Upon pressing of the switch $S_1$, the fluid cylinder 746 operates to lift the holder rod 743 via the curved arms 741 and 742. Accordingly, the container 502 is hoisted with its pulley 586 being in engagement with the holder rod 743. However, because the rod is inclined towards the empty container let-off part 700*b*, the container tends to slide toward this part and the upper recess 744 comes in engagement with the pulley 586**. The container stops its sliding as the switch $S_2$ is depressed.

Upon depression of the switch $S_2$, the fluid cylinder 746 operates in the reverse manner and the container is placed on the horizontal belt 732 of the let-off part **700*b*. When the placing of the container on the horizontal belt 732** is completed, the switch $S_3$ is closed, thereby the presence of the empty container is announced.

On the other hand, the container **502*d* on the belt 702 is brought to the position, whereat the preceding container 502*c* has been placed, by the running of the drive motor 711 in order to initiate the discharge of the cops. At the same moment, the switch $S_4$ is opened by the container 502*d*. By this opening of the switch, it is announced that the horizontal belt 702 of the new cop reception part 700*a* of the supply station 700 is provided with an unoccupied space for reception of a new container. This announcement induces a corresponding issue of the signal for movement of the traverse assembly 800. Then, the air cylinder of the positioner assembly 701 ceases its suction of the piston rod and the piston rod 735 protrudes into the advancing path of the traverse assembly due to the force of the spring 739. Owing to this protrusion, it is known which supply station is in need of new cops and the traverse assembly 800** initiates its movement.

The traverse assembly 800 carries a container 502*e* mounted thereon, the mounting of the container being confirmed by the pressing of the switch $S_5$. When the switch $S_6$ is depressed by the traverse assembly 800 and the switch $S_7$ is depressed by the full container 502*b*, the assembly 800 is in a condition ready for starting its movement. Upon arrival at the destination, the traverse assembly 800 presses the switch $S_7$ and stops, whereat the cam 817 of the assembly 800 comes in engagement with the roll of the positioner assembly 701.

When the switch $S_7$ is closed, the belt 807 is driven for circulation by the drive motor 810 and thereby, the container 502*e* is fed towards the conveyer belt 702 of the new conntainer reception part 700*a*. The belt 702 is driven for circulation by the drive motor 711 in order to receive the container so fed. However, the belt 703 does not circulate at this stage because of the provision of the one-way clutch 718. When the switch $S_4$ is depressed by the arrival of the container 502*e* at the position of the preceding container 502*d*, movements of the traverse assembly 800, the belt 807 and the belt 702 are stopped. On the other hand, by the closure of the switch $S_7$, both the belt 732 of the empty container let-off part 700*b* and the belt 812 of the traverse assembly 800 are started for circulation. The empty container placed on the horizontal belt 732, is moved onto the traverse assembly and the switch $S_8$ is depressed thereby in order to stop the circulation of the belts 732 anad 812.

When both switches $S_4$ and $S_8$ are closed, the traverse assembly 800 starts its movement returning to the initial position. It is set in position when the switch $S_6$ of the cop boxing station is depressed.

Simultaneously with the closure of the switch $S_6$, the drive motor 814 of the assembly 800 starts its running for circulation of the belt 812. At the same time, the drive motor 577 of the container reception part 600*b* starts its running for circulation of the conveyer belt 575. Thereby the empty container is received from the assembly 800 into the container reception part 600*b*. When the switch $S_9$ is kicked by the empty container, the belt 812 stops its let-off operation. The conveyer belt 575 on which the empty container is placed goes on with its circulation until the switch $S_{10}$ is depressed by the container. Meanwhile the traverse assembly 800 moves the belt 807; the let-off belt 564 of the stand-by part 600*d* starts its circulation; the full container is mounted on the traverse assembly, and the circulation of the conveyer belt is stopped when the container presses the switch $S_5$.

If the switch $S_{11}$, just under the container replacer part 600*c*, is in a closed condition when the switch $S_{10}$ is depressed by the empty container, that is, if an empty container has already been placed on that position, the newly fed empty container stands by at the position whereat it has kicked the switch $S_{10}$. Whereas, if there is no empty container at the position of the switch $S_{11}$, the fluid cylinder 585 of the container replacer part 600*c* operates when the switch $S_{10}$ is kicked by the empty container. (see FIGS. 38 and 39) Through this operation, the pulley 586 of the container is engaged by the holder rod 582 and, thereby, the container is hoisted off from the conveyer belt 575. As the holder rod 582 is inclined towards the cop storage part 600*a*, the empty container naturally slides along the inclination until the upper recess 583 comes in engagement with the pulley 586. At this moment, the switch $S_{12}$ is pressed by the pulley 586, the fluid clyinder ceases its operation, the holder rod 582 descends. The empty container then stands by at a position over the chain 569 while pressing the switch $S_{11}$.

If there is no full container at the position of the container 502*b* and the switch $S_7$ is not depressed when the switch $S_{11}$ is depressed, the drive motor 570 in FIG. 33 starts its running. The container pusher rod 565 is moved leftwards via the chain 569 and the empty container 502*f* is pushed to a position on the boxing arrangement until it presses the switch $S_{13}$. On the other hand, the full container on the boxing position is moved over one pitch by the let-off belt 564 until it presses the switch $S_7$. The pusher rod 564, that has already pushed the switch $S_{13}$, urges the hook 546 for a counterclockwise turning in FIG. 35; the connecting rod 545 is pulled via the damper spring 547, and; the L-shaped lever 542 is turned in the counterclockwise direction. At the same time, the L-shaped lever 555 is turned so as to open the closure segment of the container and the cops can be encased into the container from the underside. Lateral play of the container is well restricted by the engagement of the L-shaped lever with the base portion of the container. Simultaneously, as is clear from FIGS. 35 and 36, also the stopper 560 engages with the projection 561 of the container in order to prevent the rightward movement of the container. Meanwhile, the pusher rod that has pressed the switch $S_{13}$ returns to its initial position whereat it kicks the switch $S_{14}$.

After one cyclic of operation is completed, the switches $S_5$ and $S_6$ are closed. After that, the traverse assembly restarts its movement when the switches $S_3$ and $S_4$ are closed.

As is clear from the above description, in the case of the present embodiment, cops can be stocked by utilizing the containers. Therefore, even when any malfunction happens in any part of the arrangement, supply of the cops to the automatic winder can be carried out without any interruption. Further, by installing multiple cop boxing stations 600 side by side, or by installing a plurality of stations for containers full of the handled cops separately from the boxing stations, it is possible to stock cops in a disposition classified according to the type of the yarns. Thereby the apparatus can be used in combination with multiple automatic winders of different yarn types. In addition, containers of heavy weight can be fully automatically processed while contributing to a remarkable reduction in manual labour.

What is claimed is:

1. An apparatus for automatically feeding cops to a cop supply device, cooperative with an automatic winder, in such a manner that the head and tail positions of said cops are adjusted or controlled, said apparatus comprising:

a cop sequencing device (B) of a high frequency vibration type for receiving cops fed thereto at random and for discharging said cops separately one by one in sequence; and means for feeding cops to said sequencing device;

a cop conveyer (401) for conveying cops issued from said cop sequencing device one by one and dropping them therefrom;

a receiver chute (423) which receives cops dropped from said cop conveyer without changing the direction of the cops;

an endless conveyer (511) provided with an L-shaped lattice (512), moved in operation laterally with respect to the moving direction of said cop conveyer (401) so that cops issued from said receiver chute (423) are discharged on said endless conveyer (511) and are brought under a cop container (502);

a cop container (502) disposed above said endless conveyer (511) and provided with an L-shaped turnable lever (555) controlled to open or close the bottom of the container (502);

a closure member (557) operated by said lever for opening said bottom for issuance of the cops or closing of said bottom for encasement of the cops;

a cop boxing means (600), disposed beyond said endless conveyer (511), for lifting a prescribed number of cops into the container so that said prescribed number of cops are successively encased in the container;

a container let-off belt (564), disposed downstream of said endless conveyer (511), for moving the container toward a following supply station (700);

a traverser assembly (800) for conveying said container in a filled or empty condition from the let-off belt (564);

a vertical lattice (724) disposed in the vicinity of the automatic winder for receiving said container from said traverser assembly;

a pair of conveyer belts (702, 703) for conveying said container out of said traverser assembly;

a cop chute (720), into which cops are supplied, and from which said cops are fed;

vertical lattices (724, 903) receiving said cops one by one from said cop chute (720); and one (903) of said vertical lattices having means for conveying cops one by one and having an apparatus consisting of an engaging member (913) and a governor block (914) at a delivery side of said one lattice for positioning said cops so that the tops and bottoms of all cops are positioned in alignment.

2. An apparatus as claimed in claim 1, further comprising a cop transfer means (406) disposed above the cop conveyer (401), so that the cops carried by said conveyer are transported into the chute (423) without changing their orientation.

3. An apparatus as claimed in claim 1, wherein said cop sequencing device comprises a plurality of receiver chutes (423).

4. An apparatus as claimed in claim 1, including a conveyer assembly (400) provided with a rotor (402), a control plate (423) and light receiver (430), and said conveyer assembly being disposed between said cop conveyer (401) and an L-shaped lattice (512).

5. An apparatus as claimed in claim 1, including an endless conveyer (511) provided with a multiple L-shaped lattice (512) in which said cops are arranged on said lattice (512) with an equal distance therebetween.

6. An apparatus as claimed in claim 1, wherein said cop boxing means (600) consists of a screw cylinder (520), a sector gear (530) and a support segment (531).

7. An apparatus as claimed in claim 1, further comprising, two lines of container let-off belts (564) and vertical lattices (724), one of which is used for conveying full containers while the other is used for conveying empty containers;

a container replacer part (**600*c***) between said two lines cooperative with said containers so that a container is transported from one line to another line.

8. An apparatus as claimed in claim 1, further comprising an engaging member (913) and a governor block (914) cooperative to regulate the fall direction of cops from said vertical lattice.

9. An apparatus as claimed in claim 1, wherein said feeding means includes a container overturning device (200) consisting of guide rails (211) and a bucket (210) thereon in which cops are contained randomly.

10. An apparatus as claimed in claim 9, further comprising an endless chain conveyer (208) for said bucket, an upper roller conveyer (103) from which endless conveyer receives said bucket in a filled condition, and a lower roller conveyer to which said endless conveyer discharges said bucket in an empty condition.

* * * * *